US009718062B2

(12) United States Patent
Pinckney et al.

(10) Patent No.: US 9,718,062 B2
(45) Date of Patent: Aug. 1, 2017

(54) CRUSHER WITH ADJUSTABLE CLOSED SIDE SETTING

(71) Applicant: McLanahan Corporation, Hollidaysburg, PA (US)

(72) Inventors: Blake Pinckney, Cedar Rapids, IA (US); Ronald B. DeDiemar, Dublin, CA (US); Lou Winchip, Cedar Rapids, IA (US); Gregory A. Young, Cedar Rapids, IA (US)

(73) Assignee: McLanahan Corporation, Hollidaysburg, PA (US)

( * ) Notice: Subject to any disclaimer, the term of this patent is extended or adjusted under 35 U.S.C. 154(b) by 421 days.

(21) Appl. No.: 14/479,897

(22) Filed: Sep. 8, 2014

(65) Prior Publication Data

US 2015/0069155 A1 Mar. 12, 2015

Related U.S. Application Data

(60) Provisional application No. 61/875,362, filed on Sep. 9, 2013.

(51) Int. Cl.
*B02C 1/02* (2006.01)
*B02C 1/04* (2006.01)

(52) U.S. Cl.
CPC ..... *B02C 1/025* (2013.01); *B02C 1/043* (2013.01)

(58) Field of Classification Search
CPC ..... B02C 1/025; B02C 1/043
USPC ..... 241/267–269
See application file for complete search history.

(56) References Cited

U.S. PATENT DOCUMENTS

| | | | | |
|---|---|---|---|---|
| 838,921 | A | 12/1906 | Velten | |
| 3,380,674 | A | 4/1968 | Bruns | |
| 3,473,744 | A | 10/1969 | De Diemar et al. | |
| 4,361,289 | A * | 11/1982 | Georget | B02C 1/025 241/264 |
| 4,398,674 | A | 8/1983 | Dremann | |
| 4,398,675 | A | 8/1983 | Nette | |
| 4,989,797 | A | 2/1991 | DeDiemar et al. | |
| 6,375,105 | B1 | 4/2002 | Haven et al. | |
| 7,942,356 | B2 | 5/2011 | Dallimore et al. | |
| 2003/0042345 | A1 | 3/2003 | Ostergaard | |

(Continued)

FOREIGN PATENT DOCUMENTS

DE 29901959 U1 5/1999

*Primary Examiner* — Mark Rosenbaum
(74) *Attorney, Agent, or Firm* — The Webb Law Firm

(57) ABSTRACT

A crusher is provided having improved wear resistance and crushing capacity. Particularly, the crusher provides an improved mechanism for adjusting the closed side setting by acting on an adjustable jaw, rather than the moveable jaw. The crusher includes a moveable jaw, an adjustable jaw, and a frame that supports the adjustable jaw and the moveable jaw such that the adjustable jaw and the moveable jaw define a crushing chamber having an upper opening for receiving a material to be crushed and a lower opening for expelling crushed material from the chamber after crushing. The crusher also includes a drive mechanism coupled to the moveable jaw for directing reciprocating motion of the moveable jaw and an adjustment mechanism coupled to the adjustable jaw for altering an angle of the adjustable jaw and, thereby, altering a closed side setting of the crushing chamber.

20 Claims, 21 Drawing Sheets

(56) References Cited

U.S. PATENT DOCUMENTS

| | | | | |
|---|---|---|---|---|
| 2004/0124295 | A1* | 7/2004 | Sugimura | B02C 1/025 241/264 |
| 2005/0242220 | A1* | 11/2005 | Azzolin | B02C 1/025 241/101.73 |
| 2006/0202075 | A1 | 9/2006 | Young et al. | |

* cited by examiner

CRUSHER WITH ADJUSTABLE CLOSED SIDE SETTING

CROSS REFERENCE TO RELATED APPLICATION

This application claims priority to U.S. Provisional Patent Application No. 61/875,362 filed on Sep. 9, 2013, which is hereby incorporated by reference in its entirety.

BACKGROUND OF THE INVENTION

Field of the Invention

The present invention relates to rock crushing machinery and specifically to a jaw type crusher including two opposing jaws, namely, an adjustable jaw in cooperation with a moveable swing jaw.

Description of Related Art

Rock crushing machinery is used to reduce large rocks and boulders into smaller rocks, gravel, or rock dust for use in construction and building industries. Hard rock generally refers to rock materials that are hard, tough, abrasive, and have low friability, such as materials produced from shot rock or gravel quarries. As such, the crushing machinery is often provided in remote locations, such as quarries or construction sites.

One type of crushing machinery well suited for reducing the size of larger hard rocks is a gravity fed jaw crusher, such as the jaw crusher disclosed in U.S. Pat. No. 6,375,105 to Haven et al. A jaw crusher includes a moveable jaw configured to cooperate with a stationary jaw. The two jaws are arranged to form a v-shaped crushing chamber disposed between crushing surfaces of the stationary and moveable jaws. The moveable jaw is coupled to an eccentric shaft through a pitman. Rotational motion of the shaft is transferred to the moveable jaw, causing linear reciprocating motion of the moveable jaw in a generally vertical direction. The motion of the moveable jaw forces the rock material against the stationary jaw as gravity causes the rock material to move downward through the crushing chamber. The crushed rock material is expelled from the chamber through a narrow opening at the bottom of the crushing chamber. The width of the narrow opening is defined as the closed side setting. The closed side setting can be adjusted using an adjustment mechanism, such as a hydraulic ram, coupled to the bottom of the moveable jaw through a toggle plate. The closed side setting may also be temporarily increased to permit non-crushable material, such as iron or other metal deposits, to pass through the crushing chamber. The closed side setting may then be returned to the previous width to continue operation.

While jaw crushers including hydraulic systems for adjusting the closed side setting are known, it has been recognized that such hydraulic systems contribute to increased wear and reduced life span for elements of the crusher. Particularly, adjusting the position of a toggle beam or toggle plate driven by the hydraulic ram inward to decrease the closed side setting of the crusher is accomplished by increasing the attack angle of the moveable jaw. Attack angle is defined as the trajectory or angle of displacement of a lower portion of the moveable jaw at the closed side setting during a crushing cycle. Increasing the attack angle reduces the crushing component of the jaw and increases the wear component of the jaw. In addition, continually altering the attack angle of the moveable jaw contributes to uneven wear along the length of the toggle plate and width of the jaw, which further reduces useful life of the machinery. Therefore, there is a need for a jaw crusher capable of adjusting the closed side setting without causing a corresponding increase in the attack angle of the moveable jaw. There is similarly a need for a jaw crusher that wears consistently and predictably following prolonged use so that the need for maintenance and replacement parts can be easily predicted. The presently invented crusher is configured to address such issues.

SUMMARY OF THE INVENTION

A crusher is provided having improved wear resistance and crushing capacity. Particularly, the invented crusher provides an improved mechanism for adjusting the closed side setting by acting on an adjustable jaw, rather than the moveable jaw. The crusher includes an adjustable jaw, a moveable jaw, and a frame that supports the adjustable jaw and the moveable jaw, such that the adjustable jaw and the moveable jaw define a crushing chamber having an upper opening for receiving a material to be crushed and a lower opening for expelling crushed material from the chamber after crushing. The crusher also includes a drive mechanism coupled to the moveable jaw for directing reciprocating motion of the moveable jaw and an adjustment mechanism coupled to the adjustable jaw for adjusting an angle of the adjustable jaw and thereby altering a closed side setting of the crushing chamber. In some embodiments, an attack angle of the moveable jaw, which is defined as the displacement angle of the moveable jaw at the closed side setting, is less than 65 degrees, and preferably between 45 degrees and 55 degrees.

In certain arrangements, an upper portion of the adjustable jaw is connected to the frame through a rotatable shaft. The moveable jaw may include a first jaw die and the adjustable jaw may include a second jaw die. The first and second jaw dies are positioned on an inner face of the jaws for contacting the material to be crushed. In some embodiments, the first jaw die and the second jaw die each include alternating ridges and troughs. In that case, the moveable jaw and the adjustable jaw may be positioned such that the ridges of the first jaw die align with the troughs of the second jaw die. The first jaw die and the second jaw die may also include opposing flat portions. The flat portions of the first jaw die may be arranged to contact the flat portions of the second jaw die when the jaws are in a closed position. The point of slight contact between the flat portions is referred to as the zero position for purposes of calibrating the crusher.

In certain arrangements, the crusher includes an adjustable support pivotally connecting the adjustable jaw to the frame. The adjustable support may include a substantially horizontal member coupled to a tension cylinder. The adjustment mechanism of the crusher may include a slide beam pivotally coupled to a compensating plate. The slide beam or compensating plate are held in place during operation of the crusher by a hydraulic ram or mechanical locking mechanism. In certain embodiments, the drive mechanism drives the moveable jaw in an up and down direction at a reciprocating rate of between about 225 and 260 rotations per minute.

In certain arrangements, the crusher includes a support structure connecting the moveable jaw to the frame. The support structure is formed from a toggle plate pivotally connected between the moveable jaw and the frame. The toggle plate may include opposing curved ends having a radius that is about one half of a length of the toggle plate. The ends may be rotatably inserted in seat portions on or coupled to the moveable jaw and frame. The support structure may also include a tension rod pivotally connected to the moveable jaw. The tension rod is connected in series with a tension spring connected to the frame. In certain embodiments, a toggle angle, which is defined as an angle between a horizontal axis and a face of the toggle plate, is complementary to an attack angle of the moveable jaw. The attack angle of the moveable jaw is defined as the angle of displacement of a lower portion of the moveable jaw at the closed side setting. The toggle angle is preferably between 35 degrees and 45 degrees. In addition, the adjustment mechanism may be configured to change the closed side setting without adjusting the toggle angle, the attack angle of the moveable jaw, or a tension of the tension spring.

According to another aspect of the invention, a system for crushing a crushable material is provided. The system includes a crusher configured to receive the crushable material. The crusher includes an adjustable jaw, a moveable jaw, and a frame that supports the adjustable jaw and the moveable jaw, such that the adjustable jaw and the moveable jaw define a crushing chamber having an upper opening for receiving the crushable material and a lower opening for expelling crushed material from the chamber after crushing. Additionally, the crusher includes a drive mechanism coupled to the moveable jaw for directing reciprocating motion of the moveable jaw and an adjustment mechanism coupled to the adjustable jaw for altering an angle of the adjustable jaw and, thereby, altering a closed side setting of the crushing chamber. The system also includes at least one sensor for measuring at least one parameter relating to operation of the crusher and a controller configured to receive the measured parameter from the at least one sensor and, based at least in part on the measured parameter, to automatically engage the adjustment mechanism to adjust the closed side setting.

In certain embodiments, the at least one sensor is one or more of an oil temperature sensor, oil condition sensor, hydraulic cylinder pressure sensor, a bearing temperature sensor, or a power sensor for measuring a motor amp level of the drive mechanism. The controller may be configured to receive the measured parameter from the one or more sensors, compare the measured parameter to a predetermined threshold value, and automatically stop the drive mechanism if the measured parameter exceeds the threshold value. In addition, the controller may be configured to engage the adjustment mechanism to adjust the closed side setting while the moveable jaw is being driven by the drive mechanism.

In certain embodiments, the controller is configured to perform a pass routine. The pass routine may include the following steps: determining that uncrushable material is in the crushing chamber based, at least in part, on the measured parameter from the at least one sensor; engaging the adjustment mechanism to increase the closed side setting to allow the uncrushable material to pass through the chamber; and after the uncrushable material passes through the chamber, engaging the adjustment mechanism to reset the closed side setting to a predetermined value.

In certain embodiments, the controller is configured to perform a calibration routine. The calibration routine may include the following steps: closing the adjustable jaw of the crusher with the adjustment mechanism; measuring a pressure level of a hydraulic cylinder coupled to the adjustment mechanism with the at least one sensor; if the pressure level is greater than a threshold value, storing the position of the adjustable jaw as a zero position closed side setting; and opening the adjustable jaw a distance from the zero position to a use position.

In certain embodiments, the system also includes a feed system for supplying the crushable material to the crusher at a predetermined feed rate. In that case, the controller may be configured to perform a feed adjustment routine. The routine may include measuring a motor amp level of the drive mechanism with a power sensor or a pressure of a hydraulic cylinder of the adjustment mechanism with a pressure sensor; determining whether the motor amp level of the drive mechanism or the pressure of the hydraulic cylinder exceeds a predetermined value; and if the predetermined value is exceeded, reducing the feed rate of the feed system or adjusting the closed side setting.

BRIEF DESCRIPTION OF THE DRAWINGS

Some of the advantages and features of the preferred embodiments of the invention have been summarized hereinabove. These embodiments, along with other potential embodiments of the device, will become apparent to those skilled in the art when referencing the following drawings in conjunction with the detailed descriptions as they relate to the figures.

DESCRIPTION OF THE INVENTION

Figure 1:
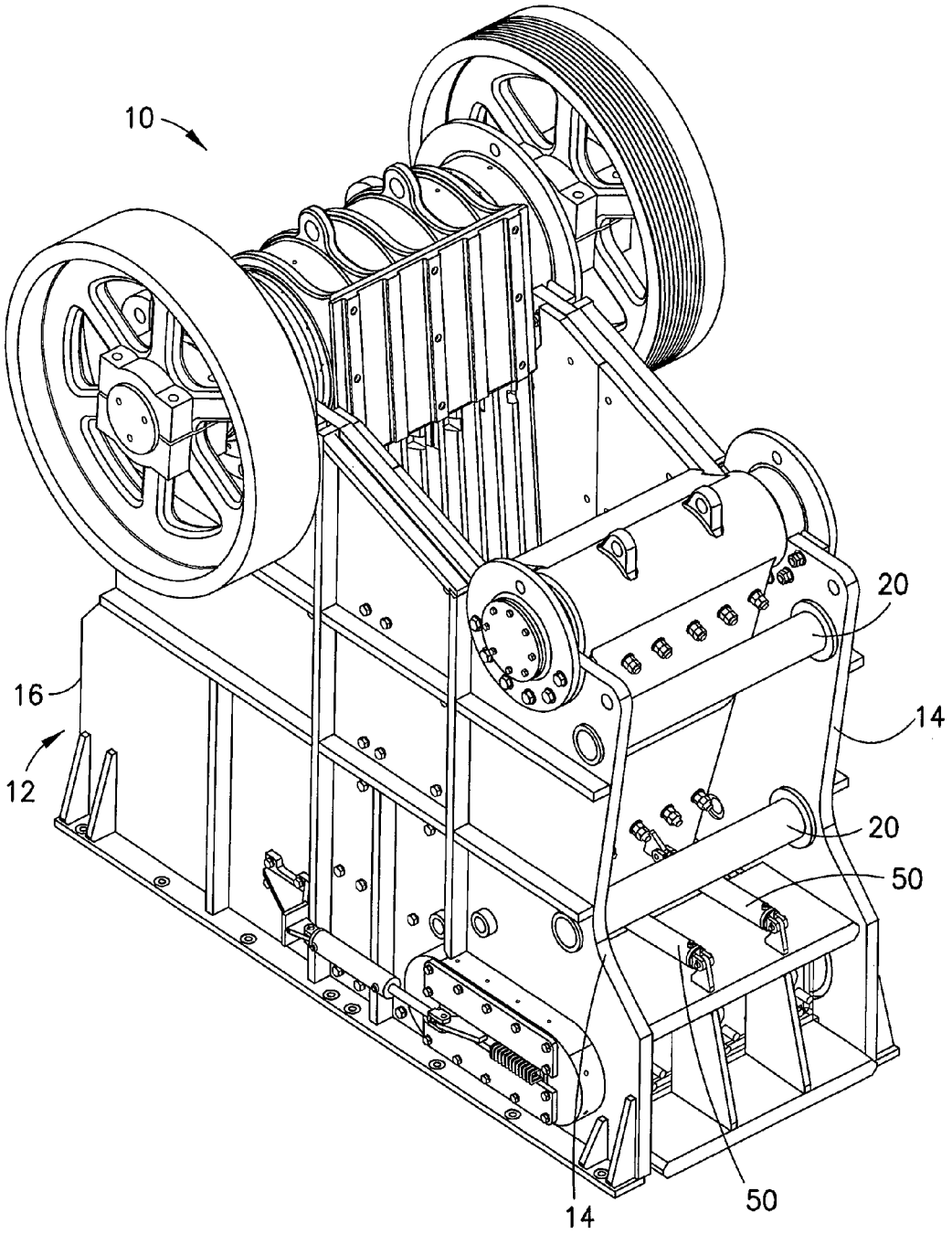
FIG. 1 is a frontward perspective view of a crusher according to an embodiment of the present invention.
Figure 2:
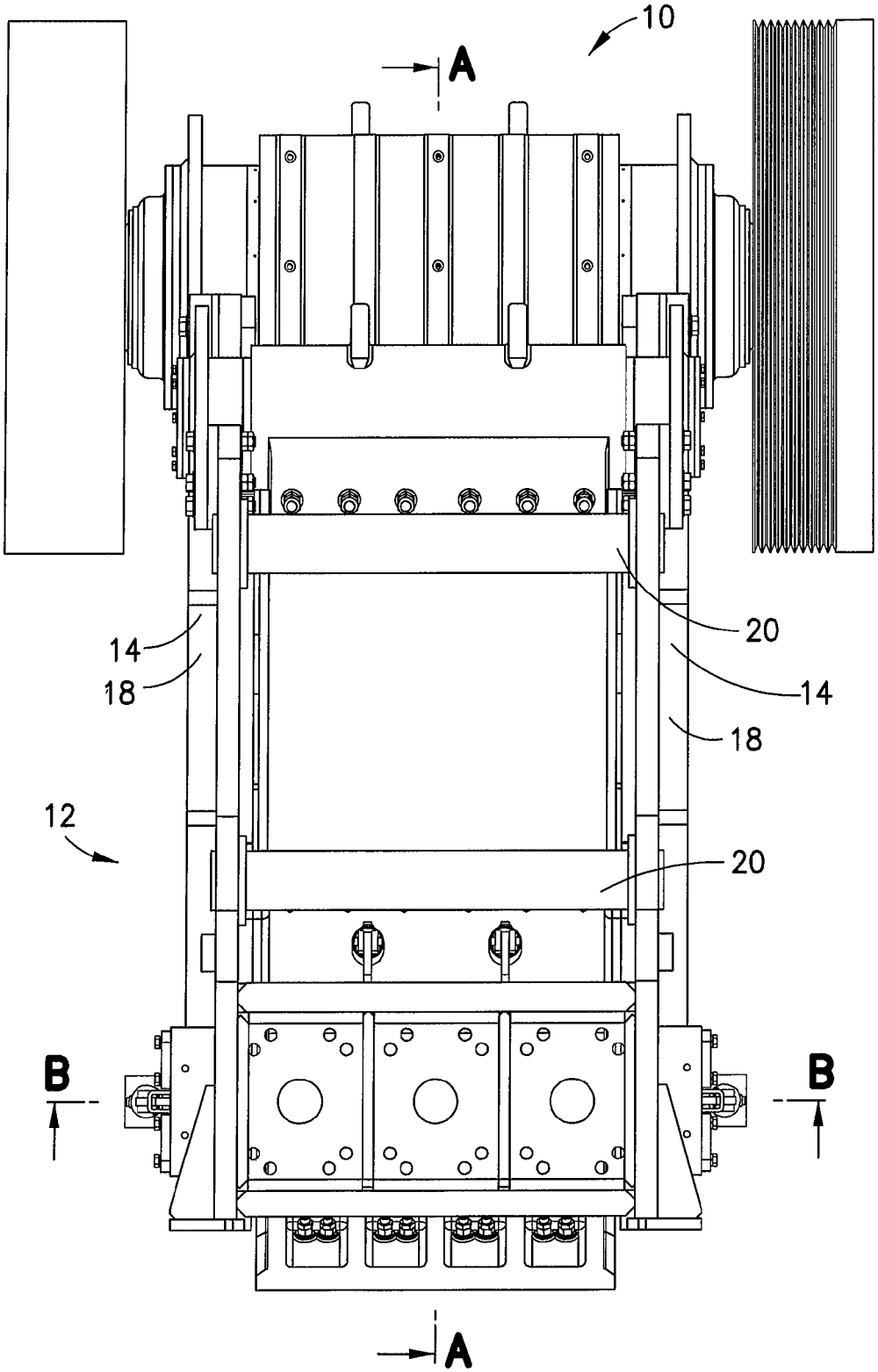
FIG. 2 is a front view of the crusher of FIG. 1, in accordance with an aspect of the present invention.

The illustrations generally show preferred embodiments of a crusher having an adjustable closed side setting. While the descriptions present various embodiments of the crusher, it should not be interpreted in any way as limiting the invention. Furthermore, modifications, concepts, and applications of the invention's embodiments are to be interpreted by those skilled in the art as being encompassed, but not limited to, the illustrations and descriptions herein. Additionally, the following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. The terms "inner" or "inward" refer to a direction toward a center of the apparatus or device. "Outer" or "outward" refers to a direction away from a center and toward an exterior of the apparatus or device. However, it is to be understood that the invention may assume various alternative variations and step sequences, except where expressly specified to the contrary. It is also to be understood that the specific devices and processes illustrated in the attached drawings and described in the following specification are simply exemplary embodiments of the invention. Hence, specific dimensions and other physical characteristics related to the embodiments disclosed herein are not to be considered as limiting. For the purpose of facilitating an understanding of the invention, the accompanying drawings and descriptions illustrate preferred embodiments thereof, from which the invention, various embodiments of its structures, construction and method of operation, and many advantages may be understood and appreciated.

A mechanical rock crusher 10 for crushing certain crushable materials, such as large rocks, stones, and similar hard materials into gravel, smaller rocks, or rock dust is provided. The crusher 10 is adapted to wear in a consistent and predictable manner following prolonged use, thereby increasing usable lifespan and reducing repair and maintenance costs for operating the apparatus. With reference to FIGS. 1-4, the crusher 10 includes a stationary frame 12 formed from opposing side panels 18 having a front end 14 and a back end 16. The panels 18 are connected by cross braces 20. In a preferred embodiment, the frame 12 is formed from fabricated or cast steel, though other known alloys may also be used within the scope of the present disclosure. To provide a frame 12 of sufficient strength to withstand compressive and impact forces produced during use of the crusher 10, the side panels 18 and cross braces 20 are welded together using any known welding technique. The frame 12 may also include various reinforcing structures, such as weldments, guards, or structural supports to further increase strength of the frame 12. Sections of the frame 12 that are most likely to be exposed to such compressive and impact forces during operation are fitted with such additional reinforcing structures.

Figure 3:
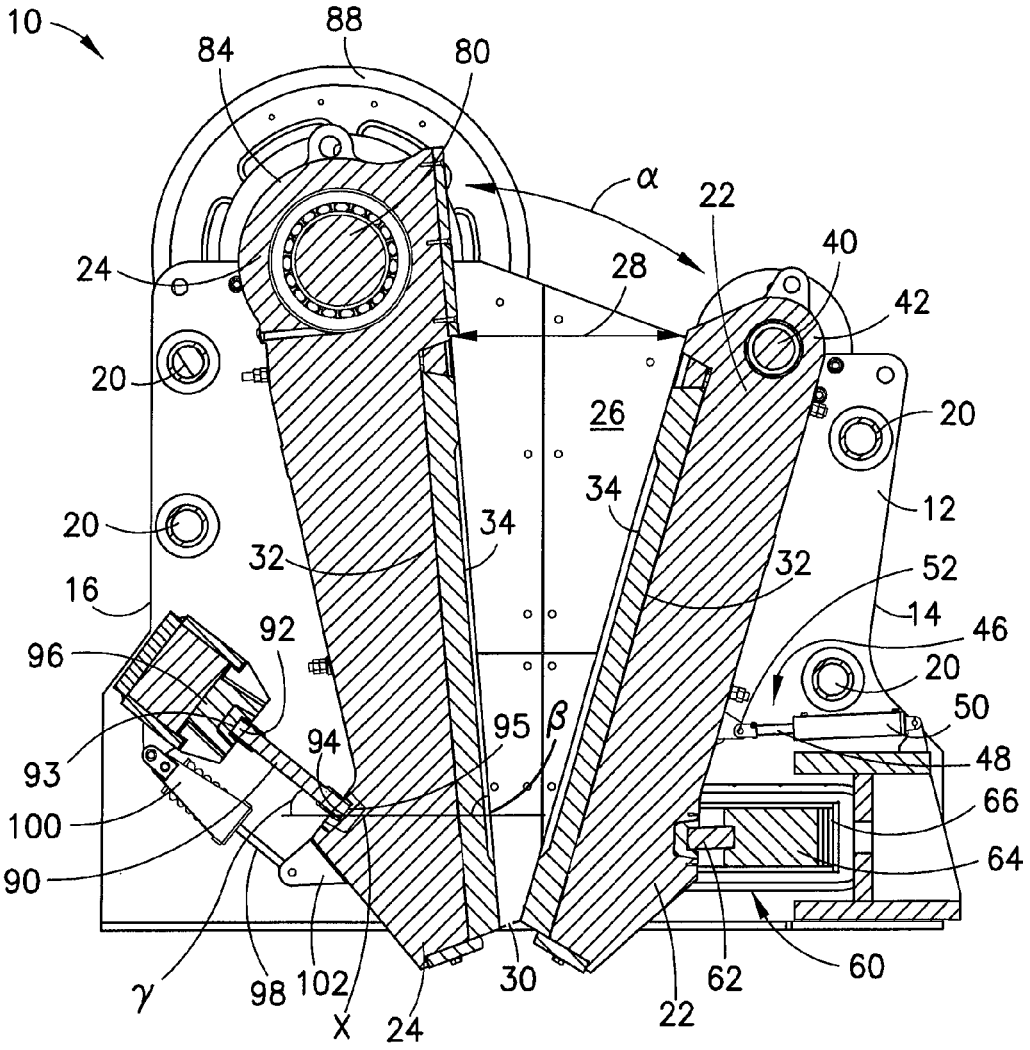
FIG. 3 is a vertical cross sectional view of the crusher of FIG. 1 taken along section A-A, in accordance with an aspect of the present invention.
Figure 4:
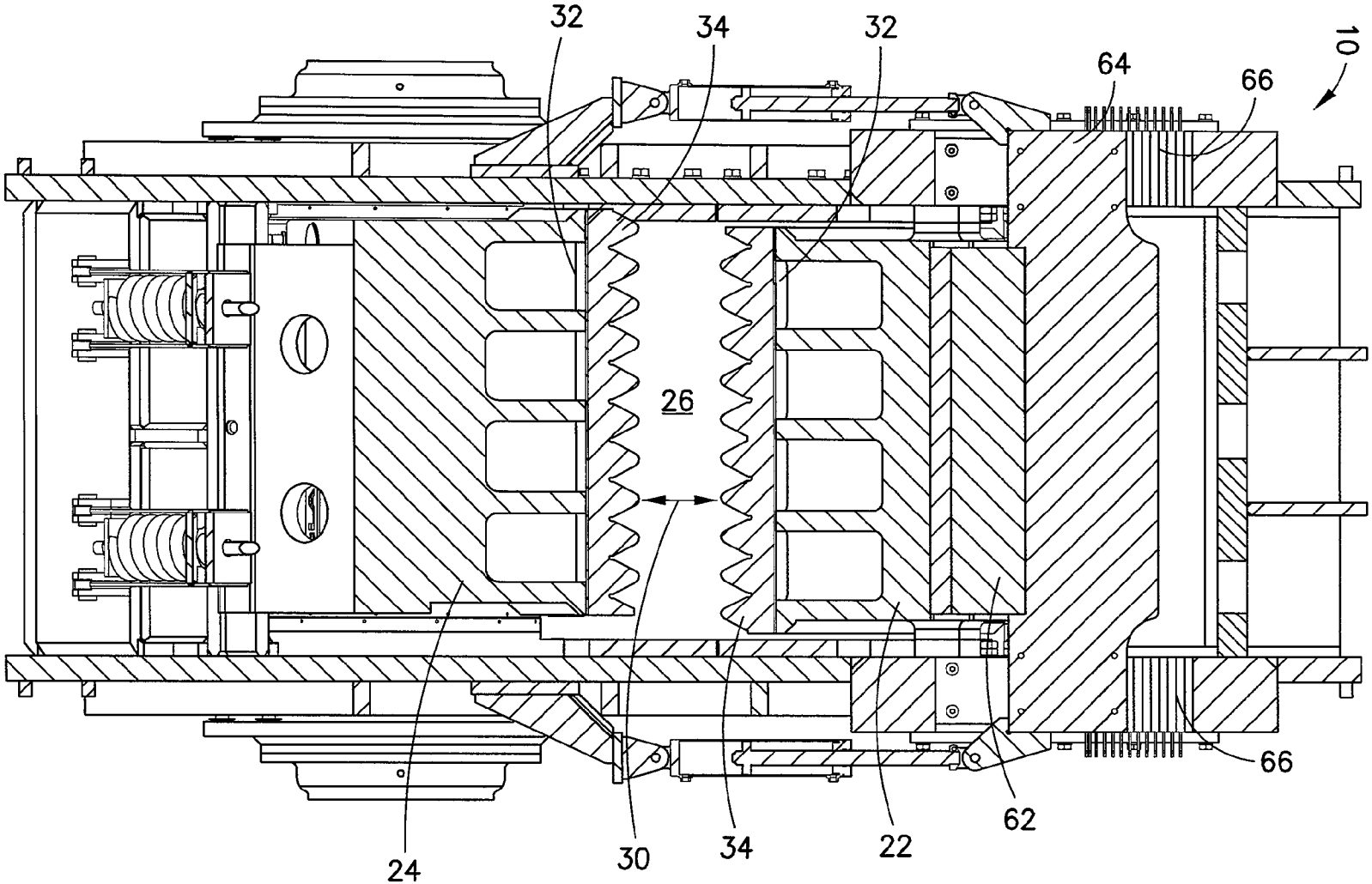
FIG. 4 is a horizontal cross sectional view of the crusher of FIG. 1 taken along line B-B, in accordance with an aspect of the present invention.

Referring to FIG. 3, the crusher 10 includes two opposing jaws, referred to hereinafter as an adjustable jaw 22 and a moveable jaw 24, positioned to form a substantially v-shaped crushing chamber 26 therebetween. Each jaw 22, 24 may be a single unitary structure or may be formed from multiple pieces, such as a top piece and a bottom piece. The crushing chamber 26 is a gravity fed chamber configured to receive the crushable material from any of a variety of feed systems. The crushable material is received through a wider upper opening 28 and is expelled, as crushed material, through a narrower lower opening 30 at the bottom of the chamber 26. The upper opening 28 determines the feed size that the crusher 10 is capable of accepting and is determined based on the requirements for the particular crushing activity being performed. Generally, the crusher 10 is capable of accepting material up to about 80% of the width or gape of the upper opening 28. In certain embodiments, the upper opening 28 is about 44 inches wide and is capable of accepting rock material up to about 35 inches as a maximum dimension.

The crushing chamber 26 may be asymmetrical with respect to a vertical axis of the chamber 26. For example, the angle of the adjustable jaw 22 may be steeper than the angle $\beta$ of the moveable jaw 24. A nip angle $\alpha$, defined as the included angle between the adjustable jaw 22 and the moveable jaw 24, is preferably between about 20 degrees and 24 degrees.

The adjustable jaw 22 and the moveable jaw 24 are configured to repeatedly contact the material to be crushed until the material is reduced to a size sufficient to pass through the lower opening 30 of the crushing chamber 26. The width of the lower opening 30 is referred to as the closed side setting.

In certain embodiments, the closed side setting is adjustable so that the crusher 10 can be used to produce crushed material of different sizes. Particularly, the adjustable jaw 22 can be repositioned prior to use from a zero position for calibrating the crusher 10, in which the lower ends of the jaws 22, 24 osculate or come into close contact to a use position. The use position determines the size of the crushed material produced by the crusher 10 and can be set to any suitable dimension.

Figure 10A:
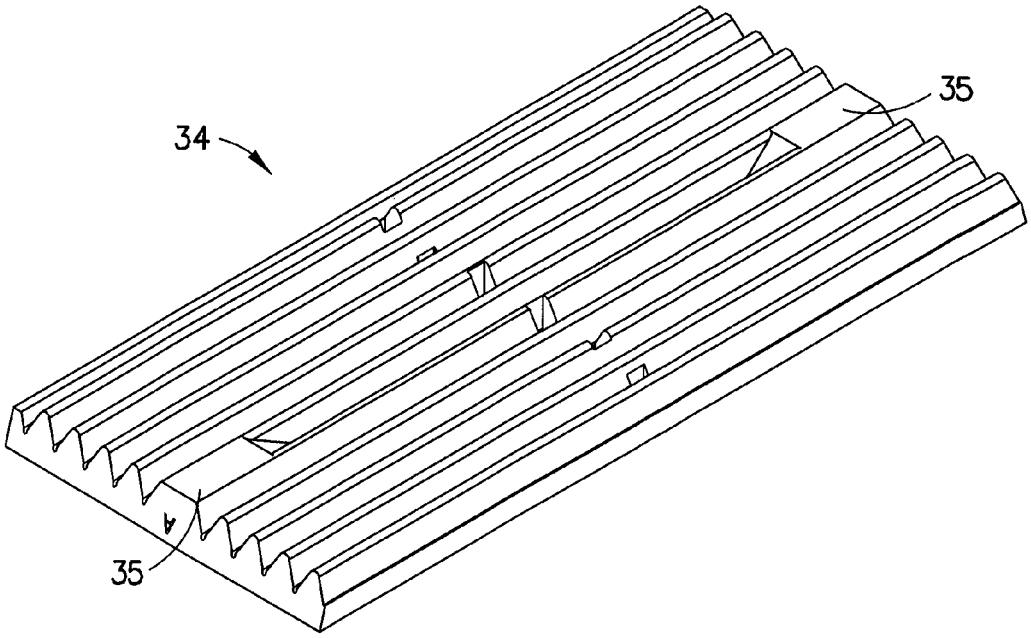
FIG. 10A is a perspective view of a jaw die for use with the crusher of FIG. 1, in accordance with an aspect of the present invention.
Figure 10B:
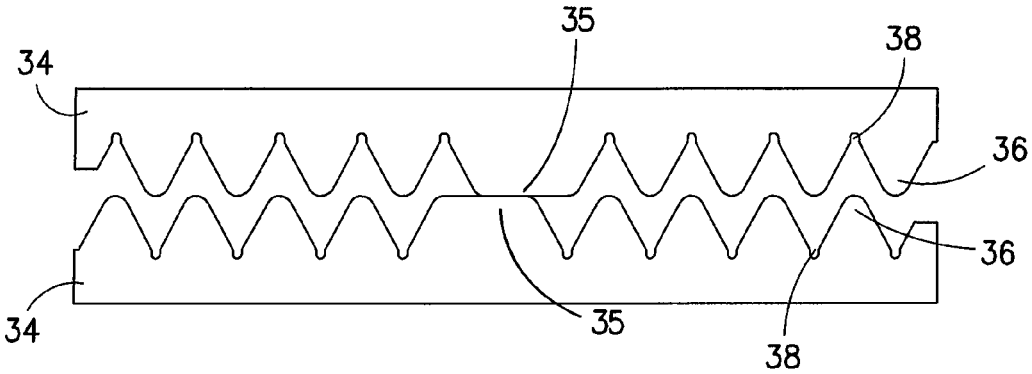
FIG. 10B is a side view of opposing jaw dies for use with the crusher of FIG. 1, in accordance with an aspect of the present invention.
Figure 11A:
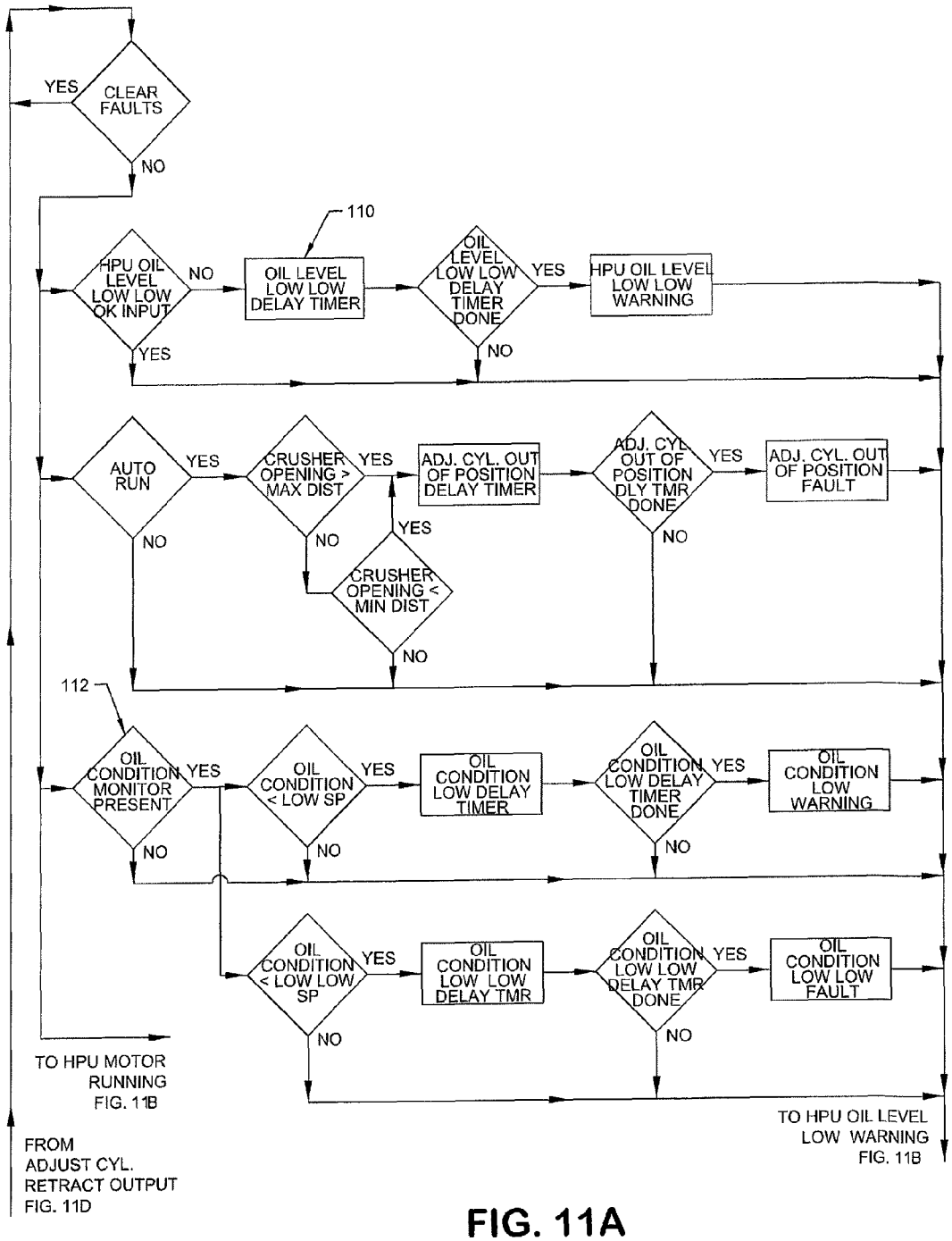
FIGS. 11A-11D are flow charts illustrating portions of a routine for operation of a hydraulic power unit of a crusher, according to an embodiment of the invention.
Figure 11B:
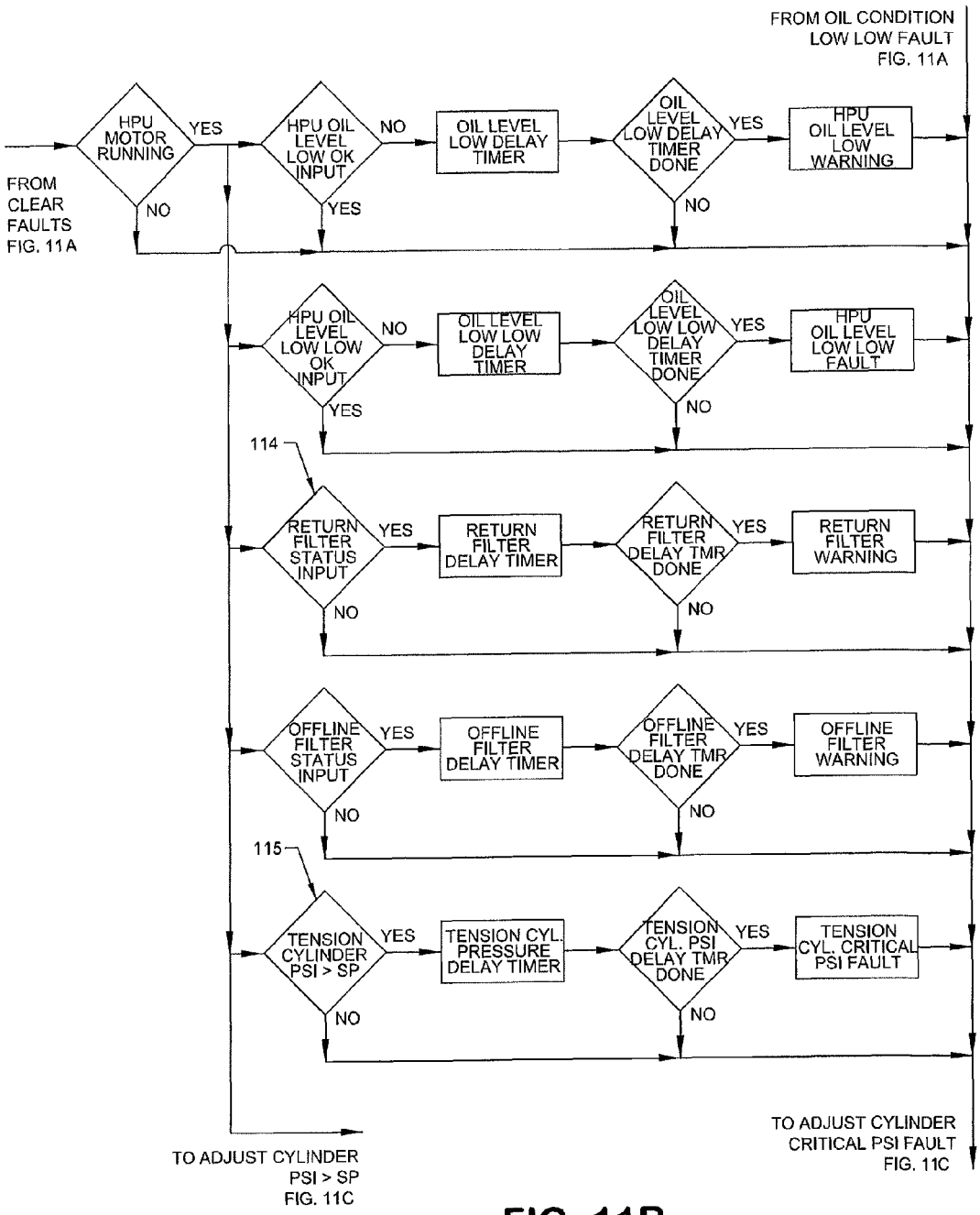
Figure 11C:
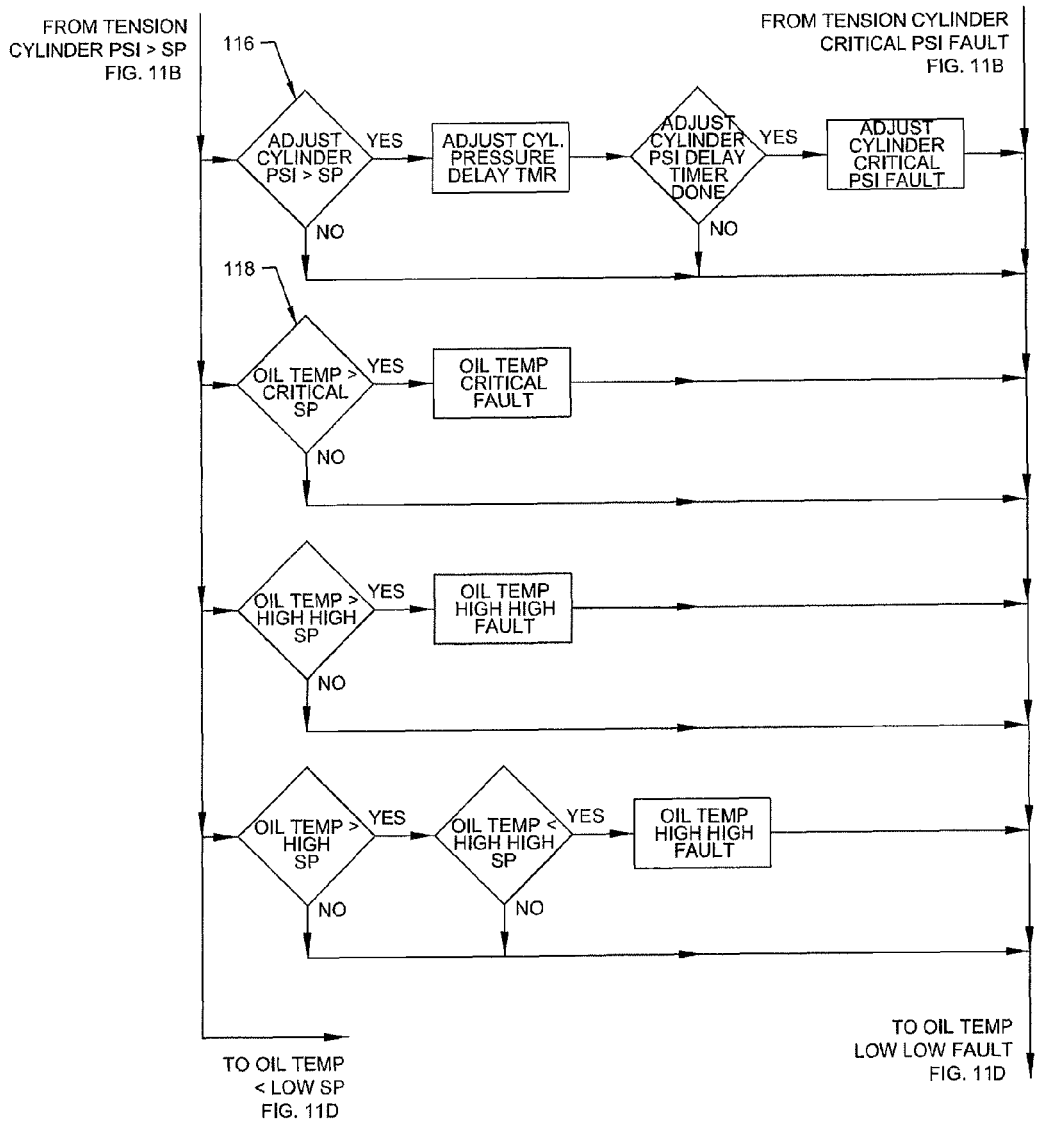
Figure 11D:
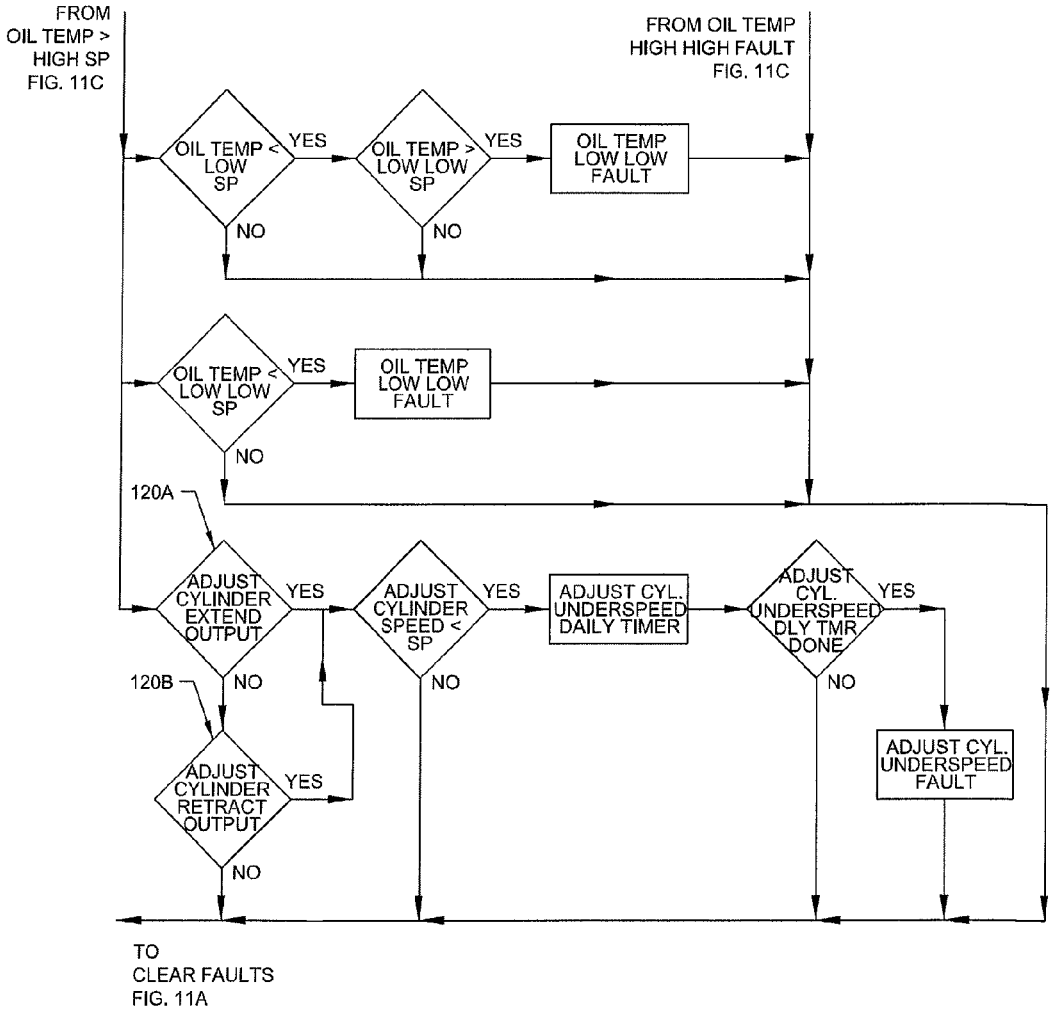

With continued reference to FIG. 3, the moveable jaw 24 and the adjustable jaw 22 are provided with wear plates 32 connected to an inner face of the jaws 22, 24. Replaceable jaw dies 34, which form a crushing surface, are attached to the wear plates 32. The jaw dies 34 may be identical in structure and include identifying marks to allow proper installation to each jaw 22, 24. The jaw dies 34 may be attached to the wear plates 32 by a mechanical fastener, as is known in the art. For example, the jaw dies 34 may be clamped between a boltable wedge (not shown) at a top portion of each jaw 22, 24 and a replaceable toe plate (not shown) located at the bottom of the jaws 22, 24. If necessary, fasteners, such as center bolts, may also be used to minimize warping of the dies 34. The jaw dies 34 form a removable and replaceable lining for the jaws 22, 24 that can be removed and replaced when needed. The jaw dies 34 are formed from a hard material, such as manganese steel, and can be designed to suit different crushing conditions. For example, as shown in FIGS. 10A and 10B, the jaw dies 34 have alternating ridges or teeth 36 positioned so that the ridges 36 of one jaw die 34 align with troughs 38 of the jaw die 34 on the opposing jaw 22, 24. The profile of the wear plate 32 and jaw die 34 may be straight, as depicted in FIG. 3, or curved depending on the desired application.

With continued reference to FIGS. 10A and 10B, the jaw dies 34 also include flat portions 35 on the ends of the die 34. The flat portions 35 provide a means for registering the zero position closed side setting (e.g., contact between opposing jaw dies 34). Specifically, during calibration of the crusher 10, the adjustable jaw 22 is advanced toward the moveable jaw 24, such that the flat portions 35 of the dies 34 just osculate or come into contact with each other. Once the zero position is registered or established, the adjustable jaw 22 can be set or reset to the use position. The distance between the jaws 22, 24 in the use position may be any suitable amount and is determined based on the registered zero position.

Figure 8:
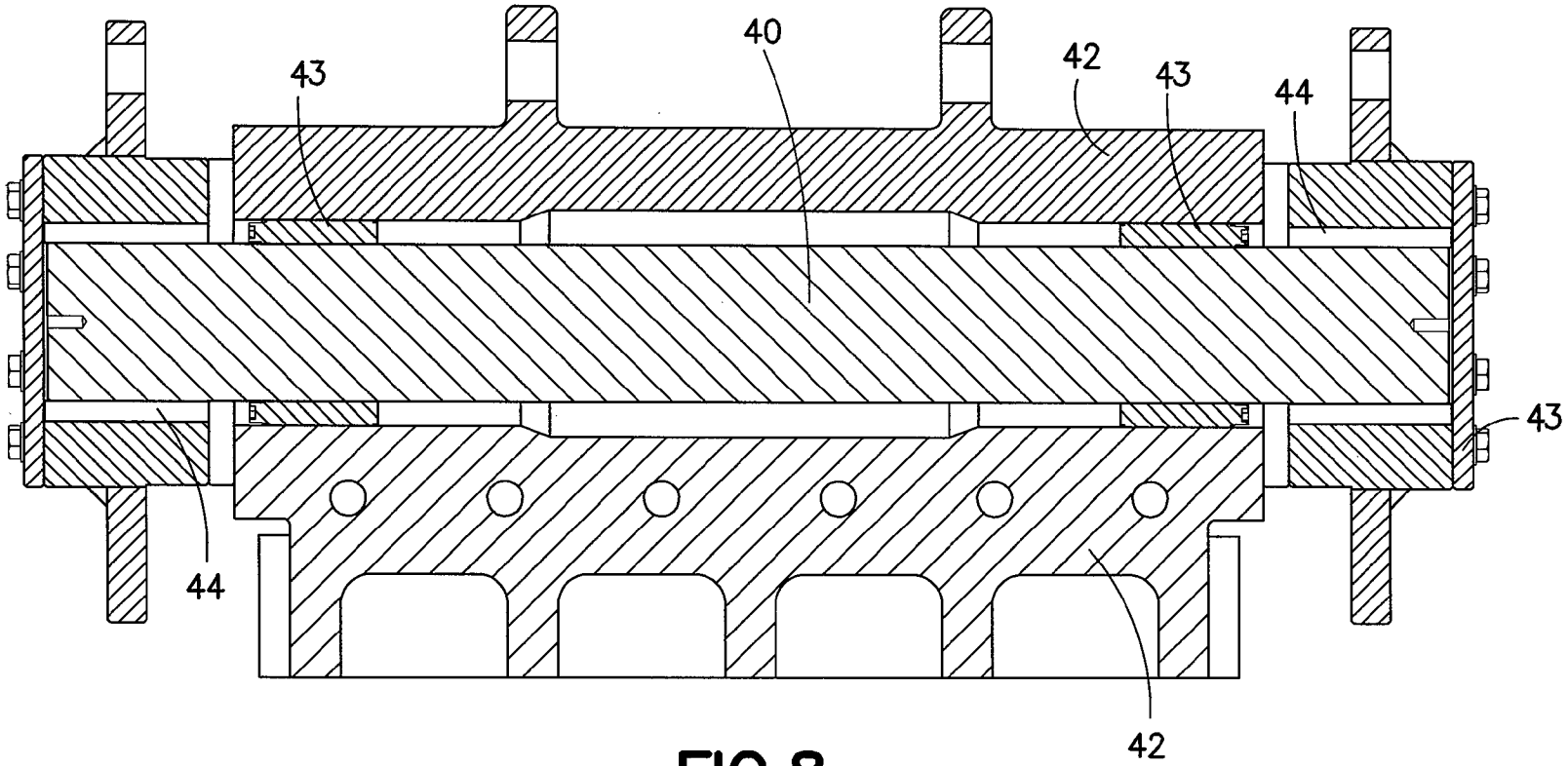
FIG. 8 is a cross sectional view of an adjustable jaw assembly of the crusher of FIG. 1, in accordance with an aspect of the present invention.

The adjustable jaw 22 is connected to the frame 12 by a cylindrical shaft 40 positioned at an upper portion of the adjustable jaw 22. As shown most clearly in FIG. 8, the shaft 40 is connected to a pitman 42 through a standard bearing 44, such as a graphite plugged bronze bearing or a roller bearing. The shaft 40 is connected to the pitman 42 with a locking ring 43. The pitman 42 forms the upper portion of the adjustable jaw 22. The pitman 42 may be integrally formed with other portions of the adjustable jaw 22 to provide a rigid singular structure. Alternatively, the adjustable jaw 22 may be formed from two or more sections, in which case, the pitman 42 is connected to adjacent sections of the jaw 22 by known fastening or adhesive means.

With reference again to FIG. 3, the adjustable jaw 22 may further include one or more supports 46 for connecting a middle portion of the adjustable jaw 22 to the frame 12. The supports 46 may be adjustable to provide support for the adjustable jaw 22 even as the angle of the adjustable jaw 22 and closed side setting are modified. For example, the supports 46 may include a substantially horizontal member 48 received within a tension cylinder 50. The horizontal member 48 extends from the tension cylinder 50 to an outer portion of the adjustable jaw 22 and is connected to the adjustable jaw 22 at a pivot joint 52. In this way, the horizontal member 48 can accommodate changes in the angle of the adjustable jaw 22 by receding farther into the tension cylinder 50 as the angle of the adjustable jaw 22 is increased.

The shaft 40 and supports 46 are configured to accommodate changes in the angle of the adjustable jaw 22. Specifically, as the angle of the adjustable jaw 22 is modified, the pitman 42, which is locked to the shaft 40 by the locking ring 43 (shown in FIG. 8), rotates through the bearing 44 (shown in FIG. 8) in a clockwise direction and the horizontal member 48 extends farther from the tension cylinder 50. Similarly, when the angle of the adjustable jaw 22 is increased, the pitman 42 rotates through the bearing 44 in a counterclockwise direction and the horizontal member 48 retracts into the tension cylinder 50.

The crusher 10 also includes an adjustment mechanism 60 for modifying the angle of the adjustable jaw 22 relative to the frame 12. Adjusting or resetting the angle of the adjustable jaw 22 changes the closed side setting for the crusher 10 by increasing or decreasing the width of the lower opening 30 of the crushing chamber 26. In one non-limiting embodiment, the adjustment mechanism 60 includes a compensating plate 62 connected between and seating to the bottom portion of the adjustable jaw 22 and a slide beam 64. The slide beam 64 can be driven forward or backward to alter the position of the compensating plate 62 and adjustable jaw 22 connected thereto. Advancing the slide beam 64 toward the adjustable jaw 22 reduces the steepness of the angle of the adjustable jaw 22 and reduces the closed side setting. Retracting the slide beam 64 and compensating plate 62 from the adjustable jaw 22 increases the steepness of the angle of the adjustable jaw 22 and increases the closed side setting. In one embodiment, the slide beam 64 is intended to be fixed in place during operation of the crusher 10. In other embodiments, the slide beam 64 may be moved during operation so that the closed side setting can be adjusted or reset without stopping the crusher 10.

The slide beam 64 may be fixed in place by a mechanism, such as a mechanical locking mechanism or hydraulic ram. For example, with continued reference to FIGS. 1-4, the mechanical locking mechanism may include a shim pack 66 disposed on either end of the slide beam 64. The shim pack 66, which consists of a plurality of members inserted at a distal edge of the slide beam 64, is configured to hold the slide beam 64 at a predetermined position to maintain the adjustable jaw 22 at a desired angle. The position of the slide beam 64 can be altered by increasing or decreasing the number of shims in the shim pack 66.

Figure 5:
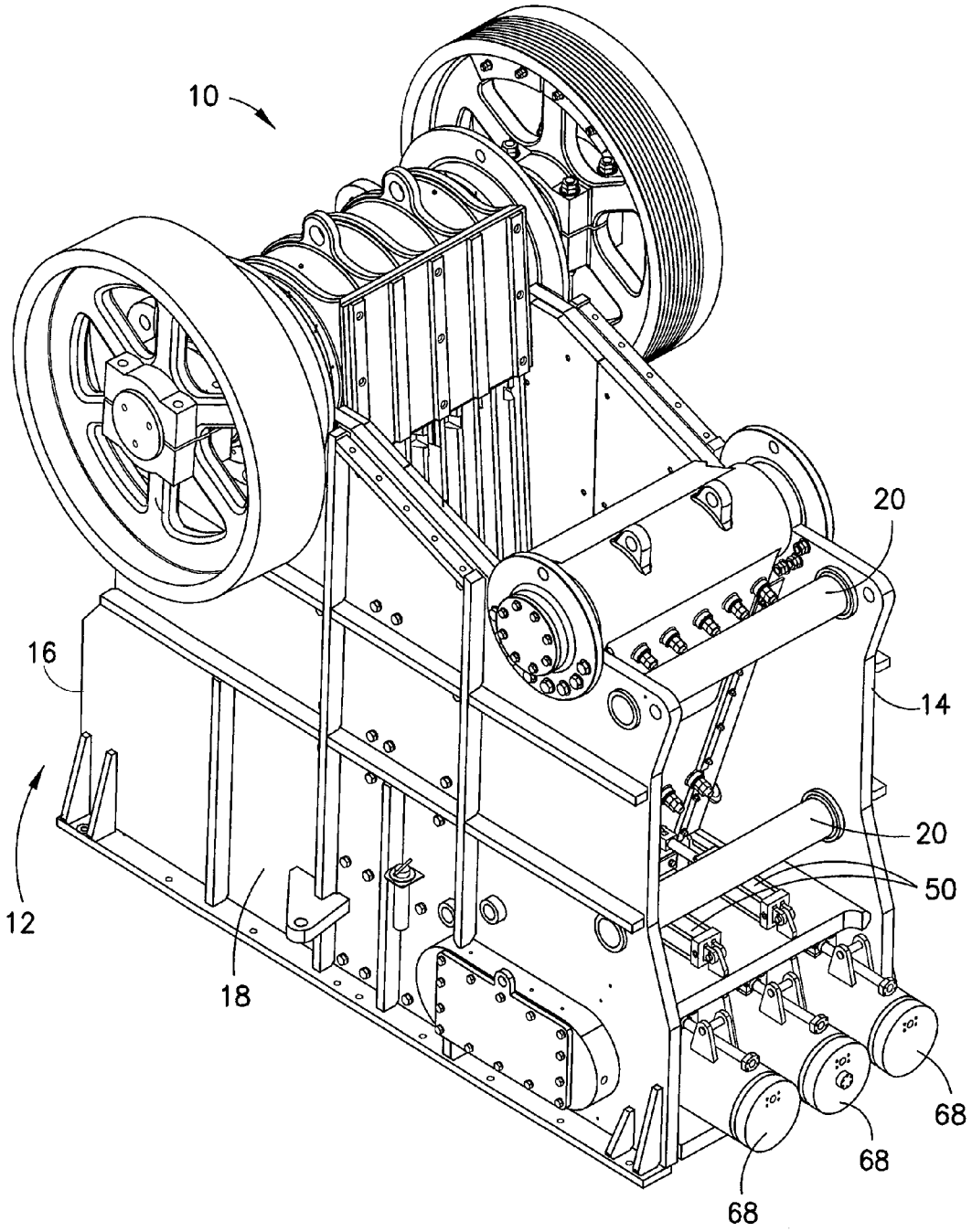
FIG. 5 is a perspective view of a crusher, in accordance with an aspect of the present invention.
Figure 6:
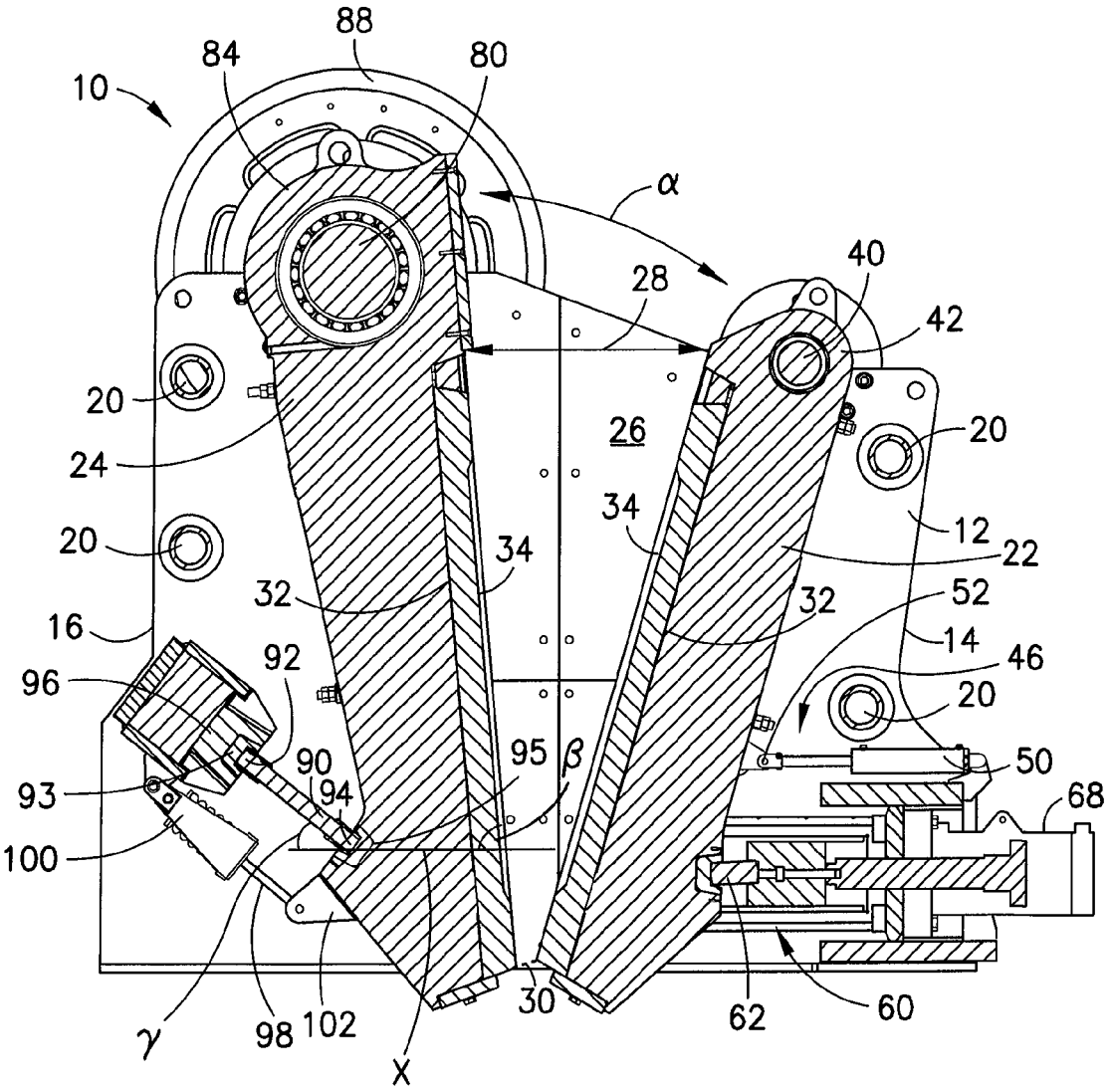
FIG. 6 is a vertical cross sectional view of the crusher of FIG. 5, in accordance with an aspect of the present invention.
Figure 7:
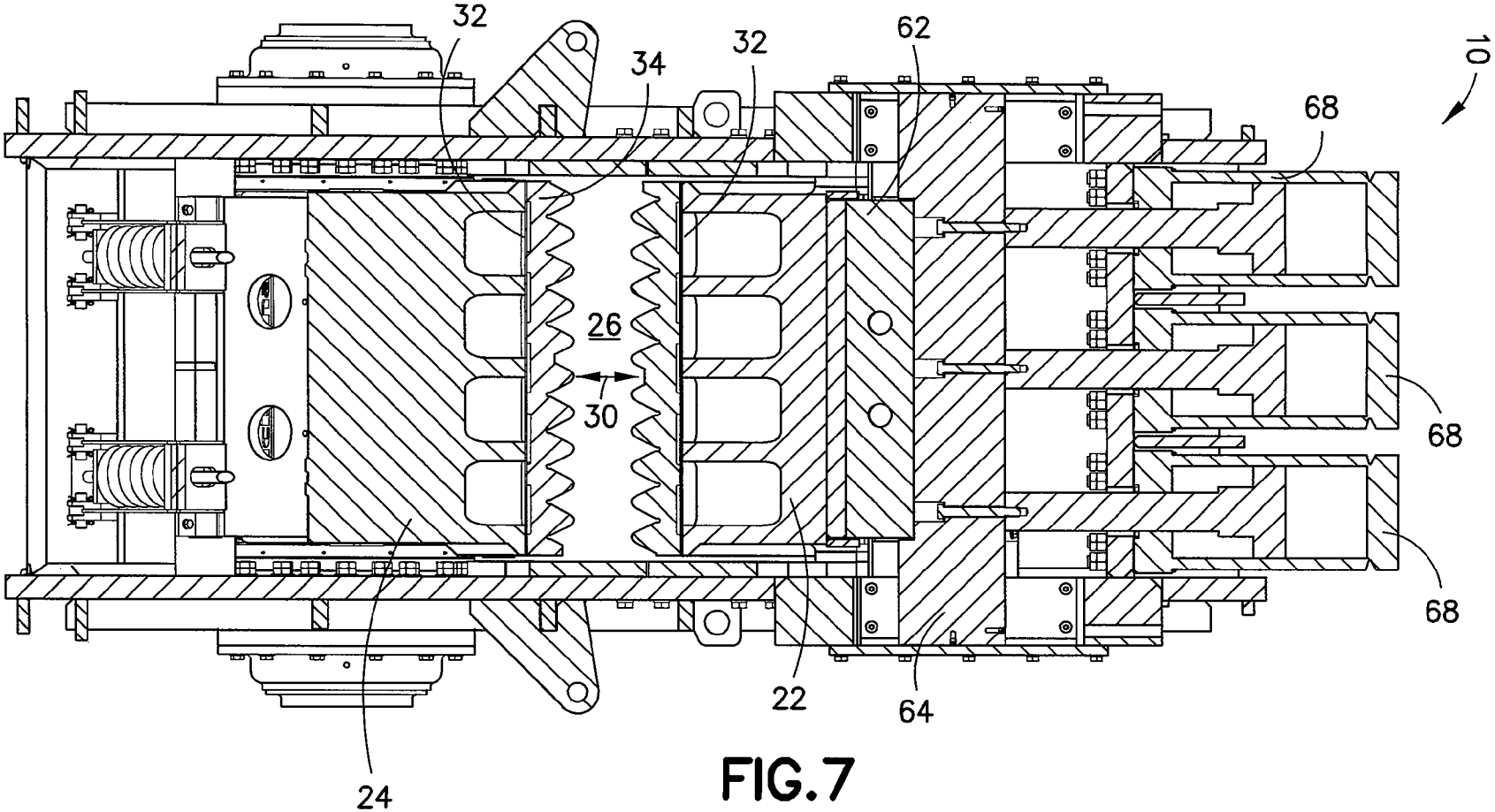
FIG. 7 is a horizontal cross sectional view of the crusher of FIG. 5, in accordance with an aspect of the present invention.

With reference to FIGS. 5-7, in a further non-limiting embodiment, the adjustment mechanism 60 includes one or more hydraulic rams 68 for controlling the, position of the adjustable jaw 22. The ram 68 is configured to drive the slide beam 64 in an inward direction, toward the adjustable jaw 22, or an outward direction, away from the adjustable jaw 22. As in the above described embodiment, the compensating plate 62 is seated between the adjustable jaw 22 and slide plate 64. As the ram 68 extends, the slide beam 64 and compensating plate 62 are driven toward the adjustable jaw 22, thereby reducing the angle of the adjustable jaw 22 and the corresponding closed side setting. When the ram 68 retracts, the slide beam 64 and compensating plate 62 are driven away from the adjustable jaw 22, thereby increasing the angle of the adjustable jaw 22 and the corresponding closed side setting. Once the closed side setting is set, the ram 68 remains in a stationary position to maintain the adjustable jaw 22 at the desired angle.

With reference again to FIGS. 1-7, the moveable jaw 24, positioned on the opposite side of the crushing chamber 26 from the adjustable jaw 22, will now be described in detail. The moveable jaw 24 is configured to move generally up and down in a rapid reciprocating motion to effectively drive material to be crushed against the jaw die 34 of the adjustable jaw 22. As will be appreciated by one having ordinary skill in the art, the lower portions of the jaw 24 move substantially vertically, while upper portions of the jaw 24 have a partially back and forth motion component. While the reciprocating rate can be selected based on the size and hardness of the material to be crushed, the speed will generally be between about 225 and 260 rotations per minute. The trajectory or angle of displacement of the lower portion of the moveable jaw 24 at the opening 30 or closed side setting is referred to as the attack angle of the moveable jaw 24.

Figure 9:
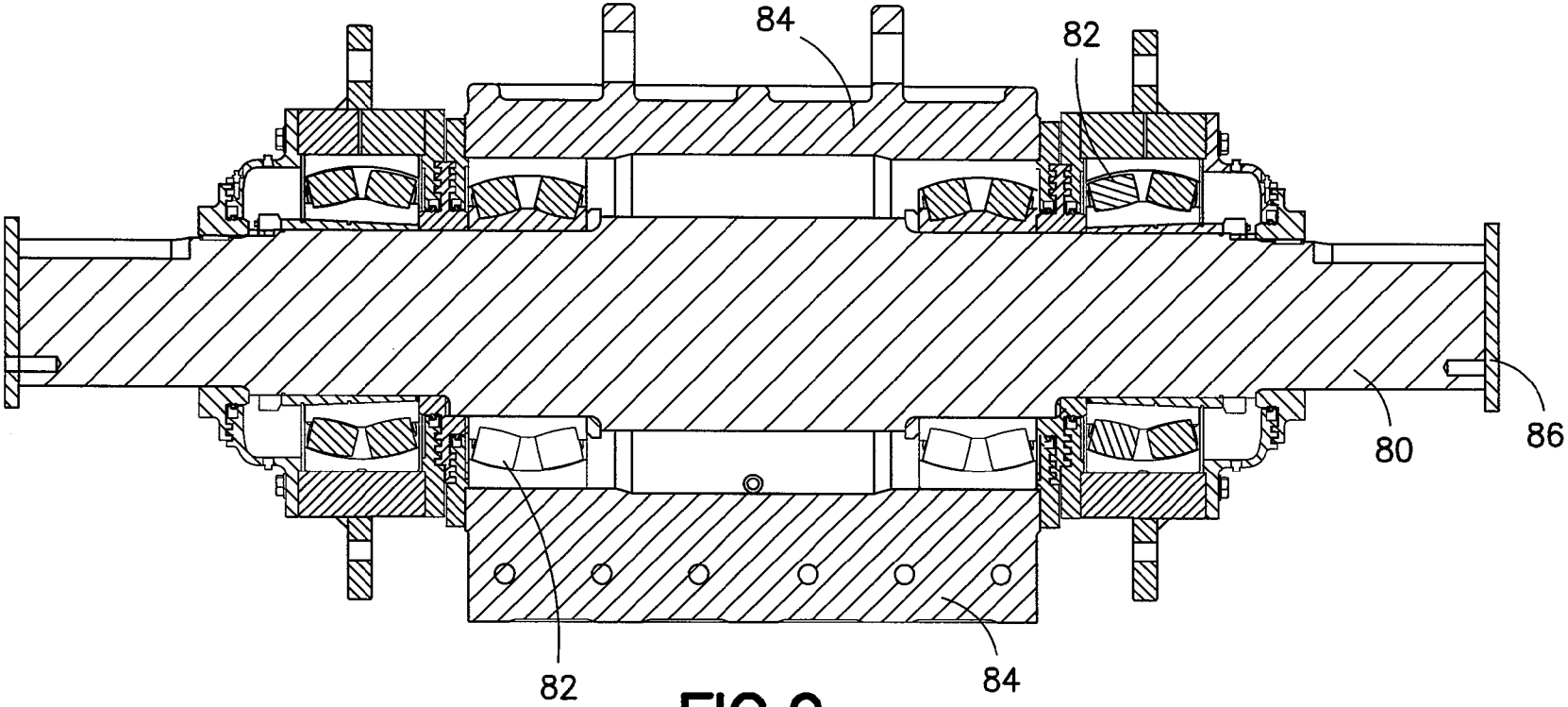
FIG. 9 is a cross sectional view of a moveable pitman assembly of the crusher of FIG. 1, in accordance with an aspect of the present invention.

The upper portion of the moveable jaw 24 is connected to the frame 12 through a cylindrical shaft 80. The cylindrical shaft 80 is connected to the frame 12 by one or more bearings 82 (shown in FIG. 9). For example, in a non-limiting embodiment, the bearings are spherical roller bearings positioned on either side of the shaft, as shown in FIG. 9. The cylindrical shaft 80 is coupled to the moveable jaw 24 through a moveable pitman 84. The moveable pitman 84 may be integrally formed with the moveable jaw 24 or may be a separate member connected to adjacent portions of the moveable jaw 24 with known fasteners or adhesives. The cylindrical shaft 80 includes a flywheel retainer 86 for connecting the cylindrical shaft 80 to a flywheel 88 (not shown in FIG. 9). The moveable pitman 84 rotates about the cylindrical shaft 80 in an eccentric path in which the rotational movement of the cylindrical shaft 80 is transferred to back and forth movement of the moveable pitman 84, to drive the generally vertical movement of the moveable jaw 24. The flywheel 88 may be connected directly to a drive mechanism, such as by a standard belt (not shown). The belt is driven by a suitable power source, such as a diesel or gasoline powered drive motor.

With reference again to FIGS. 1-7, a bottom portion of the moveable jaw 24 is connected to a support structure, such as an elongated toggle plate 90. The toggle plate 90 directs the generally vertical movement of the bottom portion of the moveable jaw 24 in conjunction with the reciprocating motion of the moveable pitman 84 and cylindrical shaft 80. The angle γ of the toggle plate 90, defined as the angle between the horizontal X axis and the face of the toggle plate 24, is depicted in FIGS. 3 and 6. Desirably, the toggle angle γ is complementary to the attack angle of the moveable jaw 24 (e.g., the sum of the attack angle and toggle angle γ is about 90 degrees). The toggle plate 90 has a first end 92 pressed against a seat 93 in a spacer 96, and a second end 94 pressed against a seat 95 in a rear face of the moveable jaw 24. The spacer 96 is coupled to a portion of the frame 12. The toggle ends 92, 94 are machined to a radius of one-half of the toggle length. It has been determined that providing a toggle plate 90 in which the toggle length corresponds to the radius of the toggle ends 92, 94 effectively reduces toggle chatter and increases the life of the toggle components. More specifically, when the toggle ends 92, 94 are machined with a radius of one half the toggle length, the toggle plate 90 rolls through a constant toggle length as the moveable jaw 24 transitions through the crushing cycle. If the radius of the toggle ends 92, 94 is not about one half of the toggle length, the toggle plate 90 does not roll through a constant toggle length during a crushing cycle. In that case, the toggle plate 90 chatters and wears the toggle ends 92, 94 and/or toggle seat 93, 95.

The bottom portion of the moveable jaw 24 is also supported by a tension rod 98 connected in series with a tension spring 100. The tension rod 98 is connected to the moveable jaw 24 at a pivot joint 102. The combination of the toggle plate 90 and tension rod 98 effectively braces the bottom portion of the moveable jaw 24 against the frame 12 to absorb and counteract impact and recoil forces from the material entering the chamber 26.

As described above, the crusher 10 is configured so that the closed side setting is adjusted by the adjustment mechanism 60 connected to the adjustable jaw 22. Accordingly, the toggle angle γ and attack angle of the moveable jaw 24 are kept generally constant even as the closed side setting is adjusted. Similarly, the tension of the tension spring 100 is kept constant and does not need to be adjusted each time the closed side setting is changed. As a result, the attack angle of the moveable jaw 24 may be permanently maintained at a shallower angle compared with presently available crushing machines.

Decreasing (e.g., making shallower) the attack angle of the moveable jaw 24 reduces wear on the jaw dies 34. Specifically, maintaining a shallower attack angle increases the crushing component or impact of the moveable jaw 24 and reduces wear along the jaw die 34. In the moveable jaw 24 having a reduced attack angle, the material to be crushed is encouraged to directly or nearly directly contact the surface of the jaw die 34 for efficient crushing. The material to be crushed is prevented from merely sliding downward along the surface of the jaw die 34, which causes wear on the jaw die 34. In a non-limiting embodiment, the attack angle of the moveable jaw 24 is less than 65 degrees. More preferably, the attack angle is between 45 degrees and 55 degrees.

Providing the toggle plate 90 at a steeper toggle angle γ relative to the moveable jaw 24 assists in maintaining the shallower attack angle. More specifically, providing the toggle plate 90 at an increased and constant toggle angle γ ensures that the bottom portion of the moveable jaw 24 moves more substantially in a back and forth direction. In contrast, if the toggle plate 90 were provided at a flatter or shallower angle, the motion of the bottom portion of the moveable jaw 24 would be more predominantly in the up and down direction. Moving the lower portion of the moveable jaw 24 more substantially in the up and down direction increases the attack angle of the moveable jaw 24. Since the toggle angle γ is desirably complementary to the attack angle, the toggle angle γ is between 35 and 45 degrees. As described above, the attack angle of the moveable jaw 24 is preferably between 45 and 55 degrees.

In contrast, in a crusher in which the closed side setting is adjusted through the moveable jaw, the toggle angle γ and resultant attack angle are not constant. Instead, the attack angle must be changed each time the closed side setting is adjusted. Adjustment of the attack angle reduces the crushing capacity of the crusher and increases wear on the jaw dies 34. In addition, adjustment of the attack angle and the closed side setting means that wear on the system is uneven and unpredictable. By adjusting the closed side setting without altering the attack angle, these problems are effectively addressed by the crusher 10 disclosed herein.

The crusher 10 may be connected with a feeder system for providing the material to be crushed to the crusher 10. For example, the crusher 10 may be fed using a vibrating grizzly feeder. An apron feeder or grizzly scalper apparatus may also be used with the crusher 10 of the present disclosure. In any case, the material to be crushed is provided to the crusher 10 from a reservoir or hopper through a vibrating trough. The feeder system could be a system with variable speed/feed ability that controls the rate at which rock or crushable material is provided to the crusher 10. The material to be crushed is dropped from the trough into the crushing chamber 26 through the upper opening 28. A feed sensor may be positioned in the chamber 26 for measuring the feed level.

Having described the structure of the mechanical components of the crusher 10 and feeder system, the hydraulic and electrical systems for automatically controlling the crusher 10 will now be described. While the crusher 10 can be operated manually without electronic or hydraulic control systems, the control systems provide improved functionality and performance. The electrical control system includes sensors for providing data regarding operation of the crusher 10 to a controller or microprocessor. For example, sensors may be configured to measure the opening distance between the jaws 22, 24, closed side setting or feed level. Sensors may also be positioned in the hydraulic power unit to measure oil level and temperature, filter status, cylinder pressure, as well as the retraction or extension of the tension cylinder 50 or hydraulic ram 68 (shown in FIGS. 5-7). Sensors may also be positioned within a lube system for measuring bearing temperatures, lube pump speed, and/or circulation time. Sensors may also be associated with the drive mechanism or motor for measuring power output or amp level of the motor. The sensors may be connected to the controller by any known connection means including wired or wireless connections. Advantageously, the electrical system and sensors permit external monitoring of the closed side setting. External monitoring is an added safety feature that ensures that users can avoid coming into contact with mechanical components of the crusher 10 during operation.

In some embodiments, the sensors may also be used to monitor the drive mechanism to determine whether the crusher 10 is operating at a preferred maximum power output, such as 80% to 90% full load amp (FLA) of the drive motor. In a simplest embodiment, the controller may be configured to shut down the crusher 10 when measured values exceed a threshold or maximum value. In this way, the crusher 10 can be stopped automatically as soon as an unsafe temperature or pressure occurs. In more complex embodiments, the controller may be configured to record data over time. The controller could then compare previously recorded data to measured data to determine changes in operation, maintenance problems, or other issues that require consideration or review by an operator or maintenance technician.

In certain other embodiments, the controller may be configured to adjust or reposition various mechanical portions of the crusher 10. For example, the controller may actuate the adjustment mechanism 60 to automatically increase or decrease the closed side setting. By adjusting the closed side setting, the size of the crushed material expelled from the chamber 26 is varied. Adjusting the closed side setting may also reduce stress on the drive motor or power output of the apparatus 10, which may prevent damage to hydraulic and mechanical components. Advantageously, the controller may be configured to actuate the adjustment mechanism 60 while the moveable jaw 24 is in use, thereby allowing a user to adjust the crusher 10 without interrupting the crushing activity. Adjusting the closed side setting while the apparatus 10 is in use also reduces downtime and increases efficiency.

In some embodiments of the crusher 10, the controller may be configured to perform a pass routine or operation for allowing non-crushable material to be expelled from the bottom opening 30 of the crusher 10. More specifically, when non-crushable material is identified by the sensors, the controller automatically adjusts the closed side setting so that the material passes through the chamber 26. Once the non-crushable material is expelled, the adjustment mechanism 60 is engaged again to return the crusher 10 to the previous closed side setting. In this way, non-crushable material may be quickly and easily expelled from the crushing chamber 26. Furthermore, since the adjustment mechanism 60 acts on the adjustable jaw 22, rather than the moveable jaw 24, the pass routine or operation may be activated while the crusher 10 is in use.

Operation of the feeder system may also be automatically controlled by the controller. For example, the controller may be configured to drive the feeder system to provide material to be crushed to maximize monitored criteria. In one embodiment, if measured FLA, pressure, or strain on the crusher 10 is perceived to be well below acceptable thresholds, the feeder system may be automatically adjusted to increase the amount of material being provided. However, if the sensors determine that pressure or temperature of components of the crusher are increasing or exceed allowable levels, the volume of material provided to the crusher 10 may be reduced to accommodate such problems.

More specifically, an automated system configured to maximize loading of the crusher 10 may measure drive motor amps and/or hydraulic cylinder pressure of a drive mechanism of the crusher 10 to determine whether the speed/feed rate should be increased or decreased. The system may automatically increase or decrease speed/feed rate to maximize the amount of time that the crusher 10 operates at a predetermined preferred power output, such as 80% or 90% of FLA of the drive mechanism or drive motor.

Having described the sensors and other electrical components of the crusher 10, a number of exemplary operation routines for the control systems will now be discussed in detail. These operation routines are presented in the form of flow charts or logic diagrams showing steps of operating the various systems and components of the crusher 10.

With reference to FIGS. 11A-11D, a routine for operating a hydraulic power unit (HPU) associated with the crusher is illustrated. Initially, the routine obtains measured parameters or values from sensors associated with the HPU oil level 110, oil condition 112, filter status 114, tension cylinder 50 (shown in FIGS. 1 and 3) pressure (psi) 115, adjustment cylinder (e.g., hydraulic ram 68 (shown in FIGS. 5 and 6)) pressure (psi) 116, and oil temperature 118. The obtained sensor parameters or values are compared against predetermined set point (SP) threshold values. If the measured parameter or value exceeds the SP, a fault is triggered. In some embodiments, a low pressure fault may be triggered in a similar manner if the measured parameter or value is below a minimum set point. In some embodiments, the fault may be displayed on a visual display to a system operator. Alternatively, the fault may cause the crusher 10 to begin a shutdown routine. The various checks may be performed as the HPU motor is running. The checks may be performed continuously or periodically according to a predetermined schedule. Once the faults are addressed, the adjustment cylinder or hydraulic ram 68 can be extended 120*a* or retracted 120*b* to adjust the closed side setting. Advantageously, the extension or retraction of the tension cylinder 50 and hydraulic ram 68 can be performed during operation of the crusher 10, reducing downtime and improving operating efficiency.

Figure 12A:
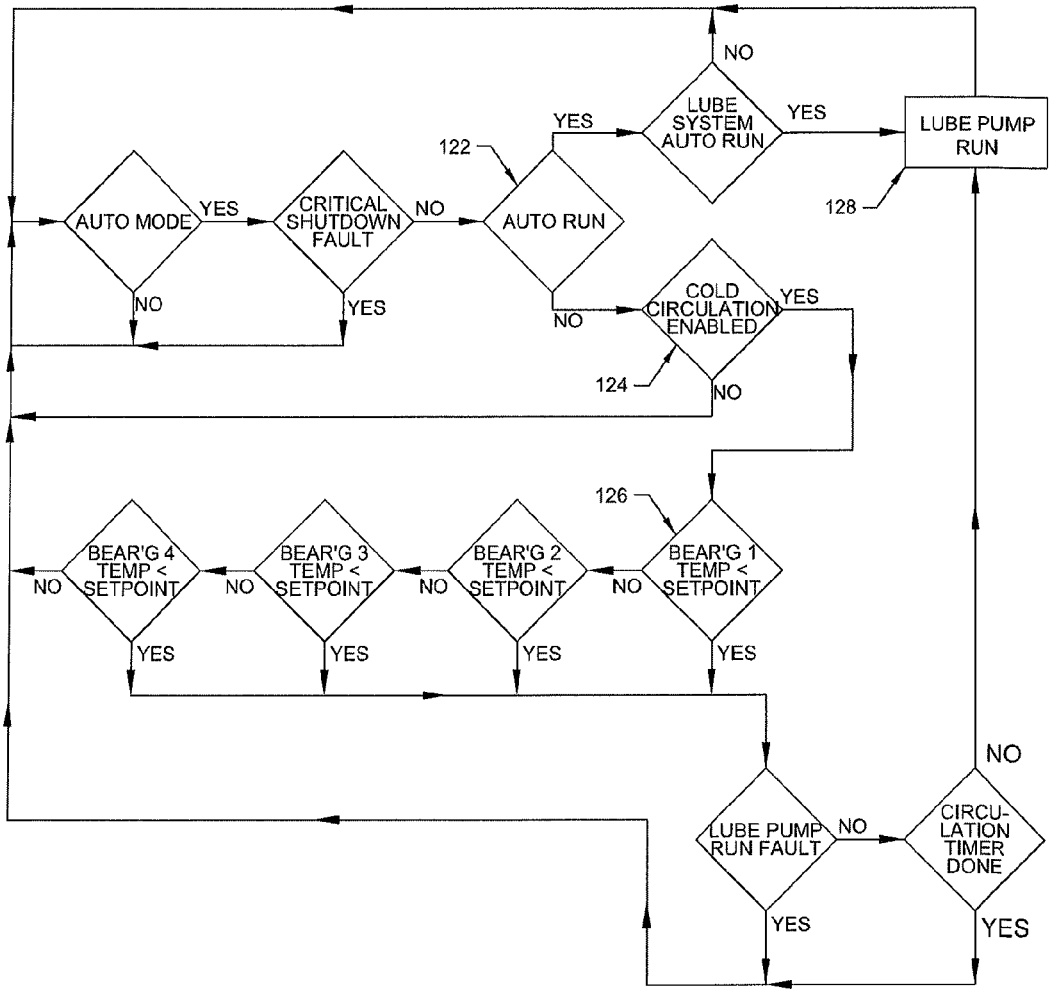
FIG. 12A is a flow chart illustrating a routine for initial operation of a lube system of a crusher, in accordance with an embodiment of the invention.
Figure 12B:
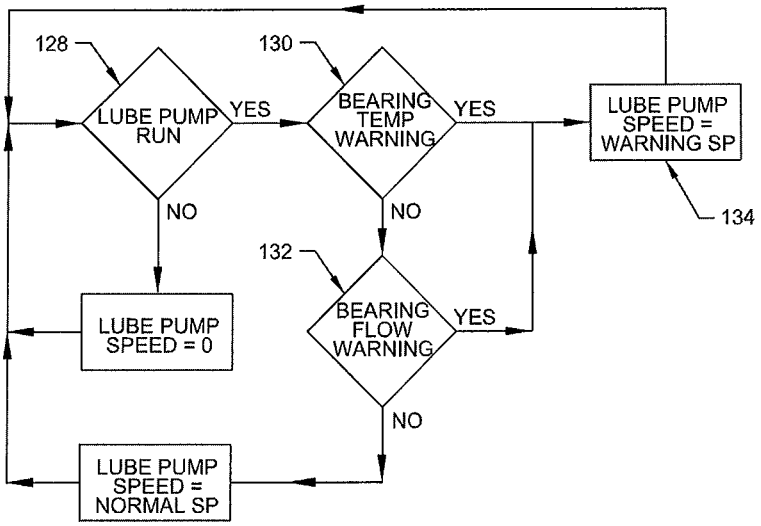
FIG. 12B is a flow chart illustrating a routine for operation of a lube system of a crusher, following the initial operation routine of FIG. 12A.

With reference to FIG. 12A, a routine for operation of a lube system of the crusher 10 is illustrated. The lube system includes a lube pump for circulation oil through the system and temperature sensors associated with the bearings of the movable jaw 24. During system startup, an auto run 122 sequence is performed. In auto run sequence 122, the lube system operates in a lube pump run state 128. If the cold circulation system 124 is enabled and the temperature of any one of the bearings is below a set point, warm oil from the reservoir is pumped through the system until the bearings reach a set point. In the lube pump run state 128, as shown in FIG. 12B, the lube pump continues to run provided that a bearing temperature warning 130 and bearing flow warning 132 are not triggered. However, if the warnings 130, 132 are triggered, the system determines that the lube pump speed exceeds a predetermined set point and, as a result, a lube speed warning 134 is provided. The system may be configured to modify the lube pump speed to address the warning 134.

Figure 13A:
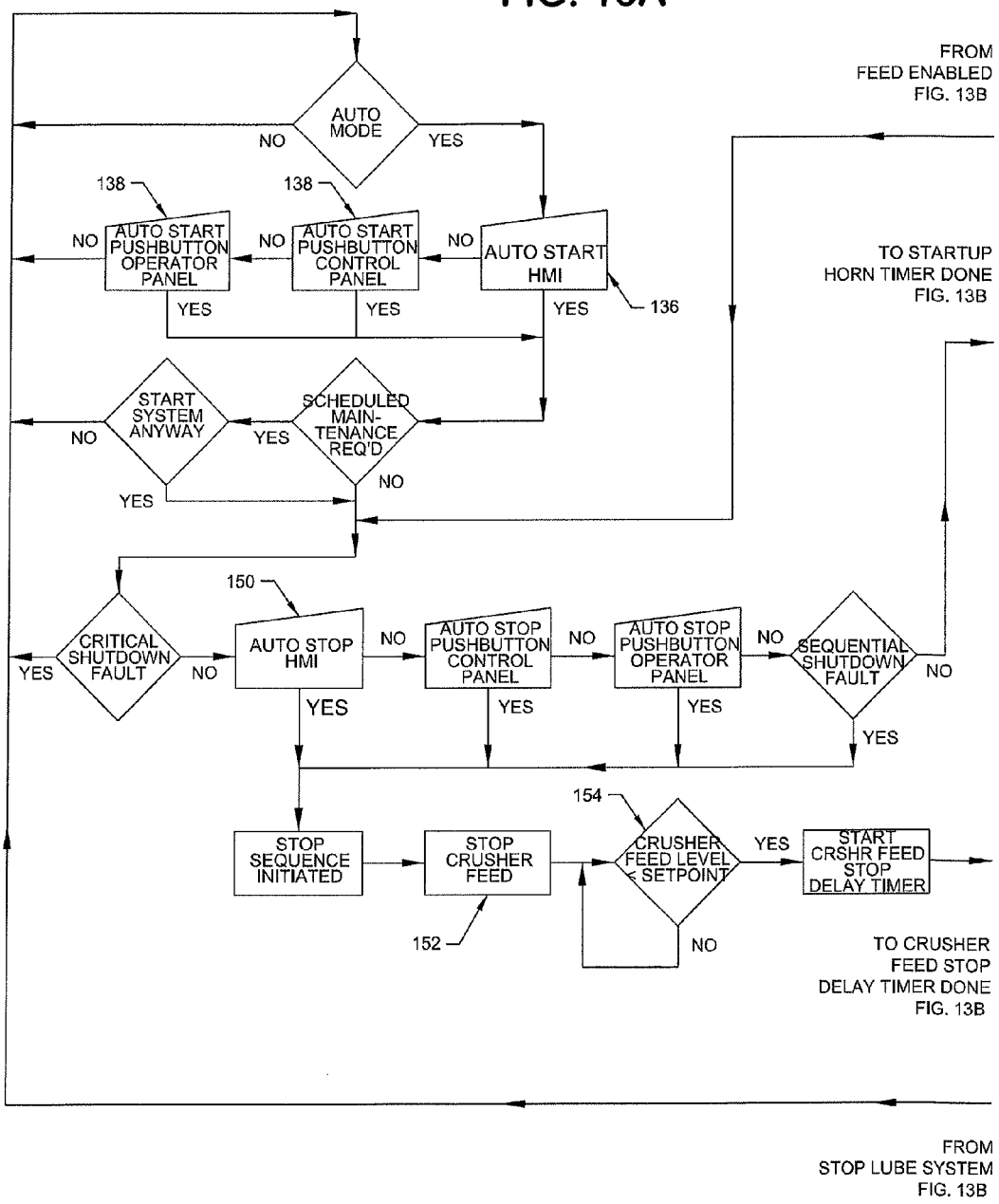
FIGS. 13A-13B are flow charts illustrating portions of automatic start and stop sequencing routines for a crusher, according to an embodiment of the invention.
Figure 13B:
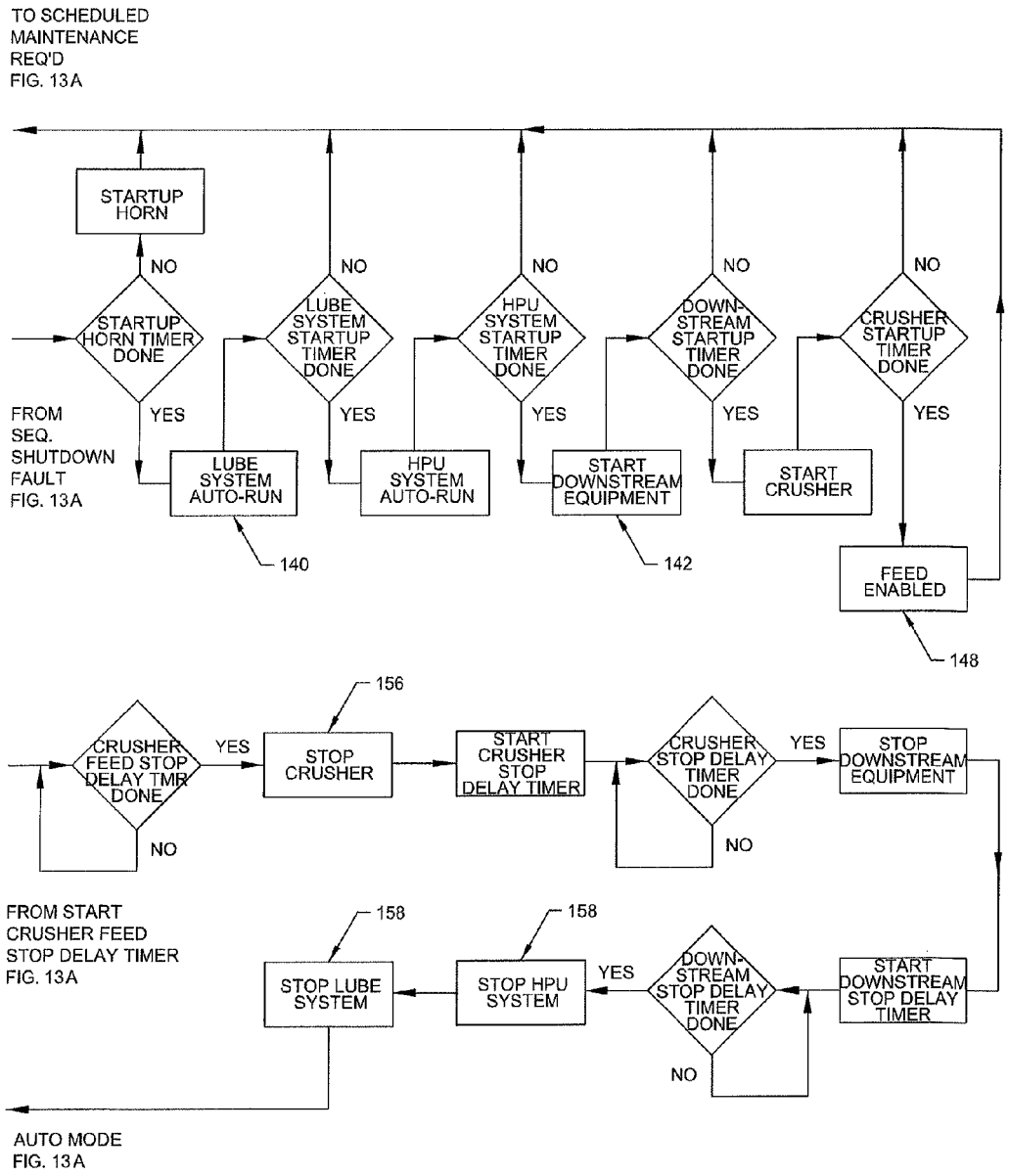

With reference to FIGS. 13A and 13B, a start-up routine and stop routine for the crusher 10 are provided. The crusher 10 may be started using an auto start algorithm 136, such as an auto start human machine interface (HMI) or a push button control 138. Upon start up, the system evaluates whether any critical shutdown faults have been triggered and, if not, actuates the lube system 140. Next, downstream equipment, such as a collection mechanism, is actuated 142. Finally, the crusher 10 is started and a feed source of material to be crushed is enabled 148. The stop sequence may be activated automatically 150, such as by an automatic stop HMI, by a manual button press, in response to a shutdown fault, or by a combination of these activation means. The shutdown fault may be triggered when uncrushable material is identified in the crusher 10 or when a system, such as the hydraulic power unit or other systems, indicate that a fault has occurred. Activating the stop sequence causes the feed source to stop 152 providing material to be crushed. Once the feed source is stopped, the feed level sensor continues to monitor feed level until feed drops below a set point 154. When the feed is below the set point, a delay timer is provided to determine how long to maintain the crushing activity. When the delay timer calculates that the correct time period has passed, the crusher is stopped 156. Another delay timer determines how long to continue running downstream components after stopping the crusher 10. After the crusher 10 and downstream components are stopped, meaning that no additional motion or driving forces are required, the HPU system and lube system are also stopped 158.

Figure 14:
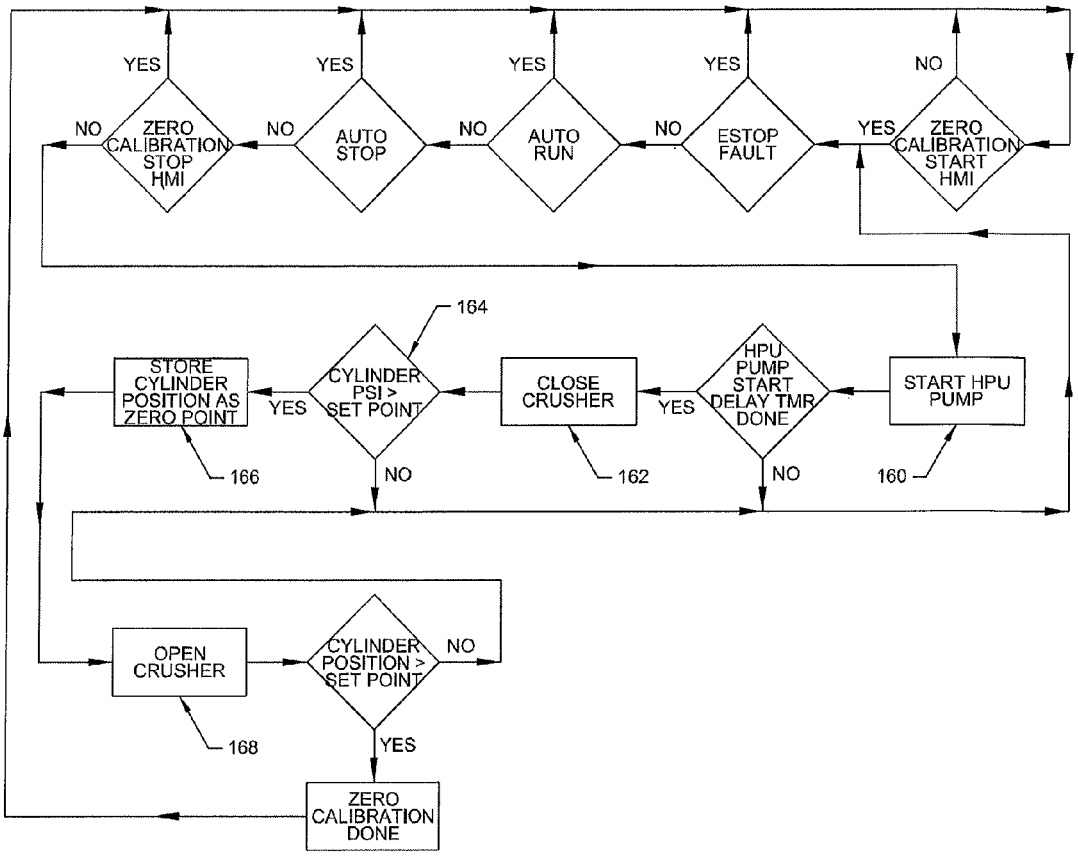
FIG. 14 is a flow chart illustrating a calibration routine for a crusher according to an embodiment of the invention.

With reference to FIG. 14, a calibration routine for the crusher 10 is illustrated. Initially, the system determines whether any faults, such as an emergency stop fault (ESTOP), have been activated. If no such faults are present, the system then determines whether the crusher 10 is already running or has already received an automatic stop command. If the crusher 10 is not already in use and has not received a stop command, the HPU pump is activated 160 and, following a time delay, the crusher 10 is closed 162. Once in the closed position, a sensor associated with the cylinder or hydraulic ram determines whether a PSI level exceeds a predetermined set point 164. If the PSI exceeds the set point, the cylinder position and corresponding position of the adjustment jaw is stored as a zero position 166. Once the zero position is recorded, the crusher 10 is opened to a use position or crushing width selected based on the size of crushed material to be produced. The use position is determined or calculated based on the zero position. Provided that the crusher 10 opens as expected, the calibration routine is complete. Calibration may be repeated or checked periodically according to a predetermined schedule. Alternatively, calibration may be performed following an event, such as each time that the closed side setting is adjusted or each time that the crusher 10 is restarted.

Figure 15A:
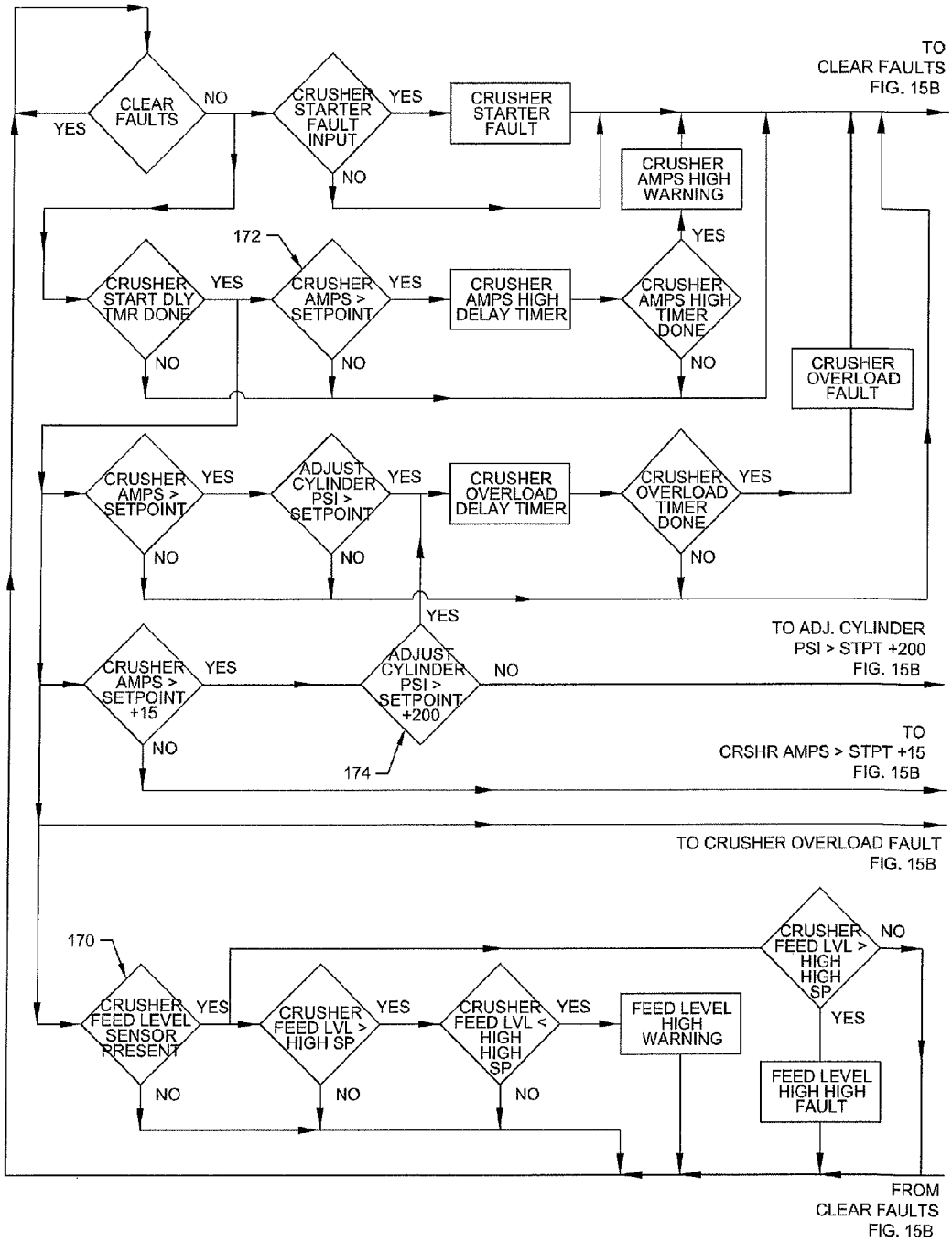
FIGS. 15A-15B are flow charts illustrating portions of routines for operating the crusher, according to an embodiment of the invention.
Figure 15B:
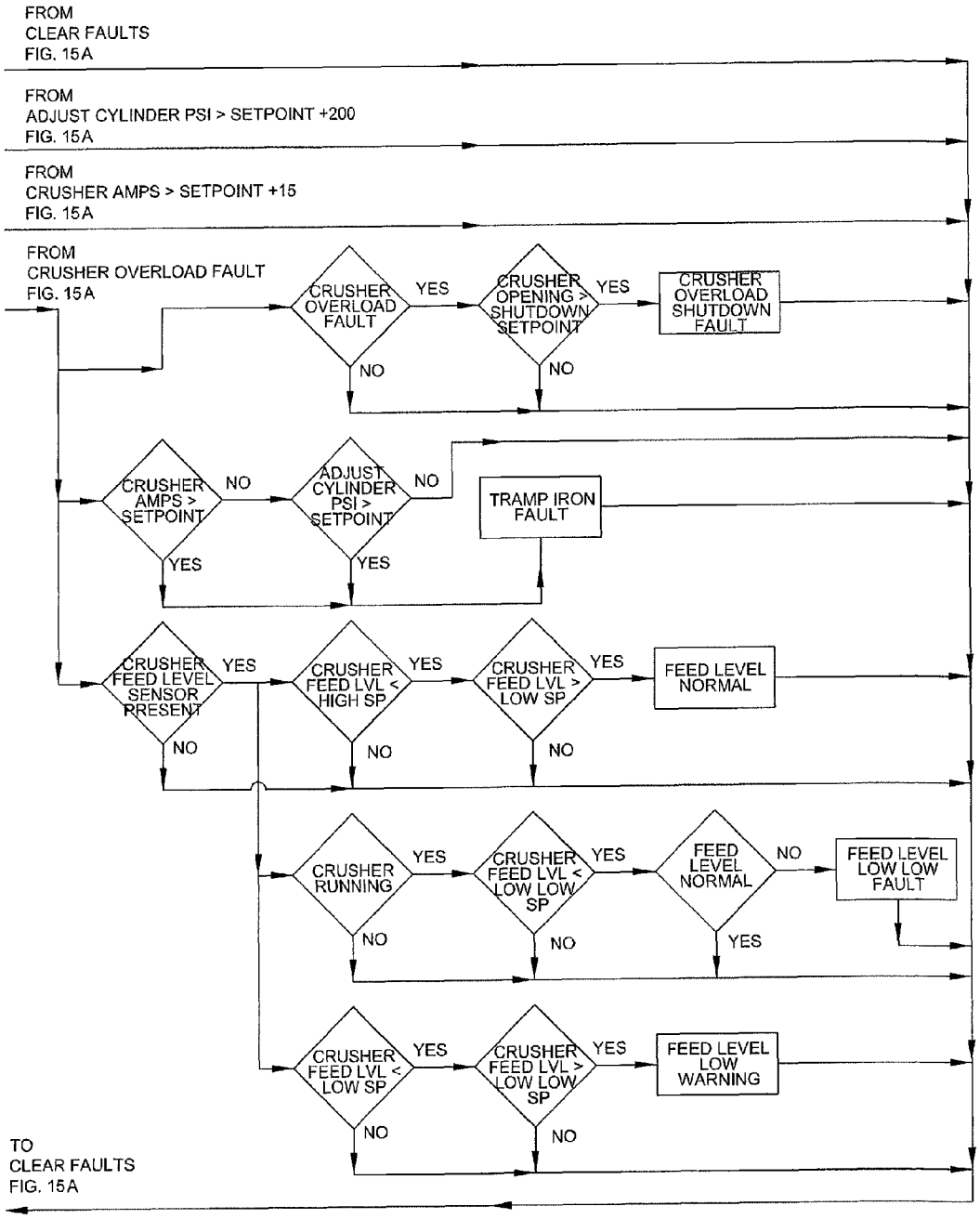

An exemplary routine for measuring and controlling the feed level in the chamber 26 (e.g., crusher feed level 170) is illustrated in FIGS. 15A and 15B. As shown in FIG. 15, sensors are provided for measuring the crusher power level (e.g., crusher amps 172) and the adjustment cylinder PSI 174. If either value is determined to be above or below a predetermined set point, a fault or warning is triggered. Additionally, a tramp iron fault may be actuated for relieving pressure in the cylinder. The system obtains a measured parameter or value from the sensor associated with the crusher feed level 170. If the feed level 170 is above or below a predetermined threshold value, a fault is triggered. In addition, the feed level 170 may be adjusted to a feed level within predetermined limits. The system may continue to monitor these values continuously or at predetermined intervals and provide faults or warnings as appropriate.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof. Further, although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A crusher comprising:

an adjustable jaw;

a moveable jaw;

a frame that supports the adjustable jaw and the moveable jaw such that the adjustable jaw and the moveable jaw define a crushing chamber having an upper opening for receiving a material to be crushed and a lower opening for expelling crushed material from the chamber after crushing;

a drive mechanism coupled to the moveable jaw for directing reciprocating motion of the moveable jaw; and an adjustment mechanism comprising a hydraulic ram coupled to the adjustable jaw, the hydraulic ram being configured to alter an angle of the adjustable jaw to adjust a closed side setting of the crushing chamber, which determines a size of the crushed material produced by the crusher, and to remain in a stationary position to maintain the closed side setting during operation of the crusher.

2. The crusher of claim 1, wherein an attack angle of the moveable jaw, which is defined as an angle of displacement of a face of the moveable jaw at the closed side setting, is between 45 degrees and 55 degrees.

3. The crusher of claim 1, wherein the moveable jaw comprises a first jaw die connected to an inner face of the moveable jaw and the adjustable jaw comprises a second jaw die connected on an inner face of the adjustable jaw, the jaw dies being configured to contact the material to be crushed.

4. The crusher of claim 3, wherein the first jaw die and the second jaw die each comprise alternating ridges and troughs, and wherein the moveable jaw and the adjustable jaw are positioned such that the ridges of the first jaw die align with the troughs of the second jaw die.

5. The crusher of claim 4, wherein the first jaw die and the second jaw die comprise opposing flat portions, and wherein the flat portions of the first jaw die are arranged to contact the flat portions of the second jaw die when the jaws are in a closed position.

6. The crusher of claim 1, further comprising an adjustable support pivotally connecting the adjustable jaw to the frame, the adjustable support comprising a substantially horizontal member coupled to a tension cylinder.

7. The crusher of claim 1, wherein the adjustment mechanism further comprises a slide beam connected to the hydraulic ram and pivotally coupled to a compensating plate, and wherein the slide beam and the compensating plate are held in place during operation of the crusher by the hydraulic ram.

8. The crusher of claim 1, wherein the drive mechanism drives the moveable jaw at a reciprocating rate of between about 225 and 260 rotations per minute.

9. The crusher of claim 1, further comprising a support structure connecting the moveable jaw to the frame, the support structure comprising a toggle plate pivotally connected between the moveable jaw and the frame.

10. The crusher of claim 9, wherein the toggle plate comprises opposing curved ends having a radius, wherein the radius of the curved ends is about one half of a length of the toggle plate and wherein the ends are rotatably inserted in seat portions on or coupled to the moveable jaw and frame.

11. The crusher of claim 9, wherein a toggle angle, which is defined as an angle between a horizontal axis and a face of the toggle plate, is complementary to an attack angle of the moveable jaw, which is defined as an angle of displacement of a face of the moveable jaw at the closed side setting.

12. The crusher of claim 11, wherein the support structure further comprises a tension rod pivotally connected to the moveable jaw, the tension rod being connected in series with a tension spring connected to the frame.

13. The crusher of claim 12, wherein the adjustment mechanism is configured to adjust the close side setting without adjusting the toggle angle, the attack angle of the moveable jaw, or a tension of the tension spring.

14. A system for crushing a crushable material comprising:

a crusher configured to receive the crushable material, the crusher comprising:

an adjustable jaw;

a moveable jaw;

a frame that supports the adjustable jaw and the moveable jaw such that the adjustable jaw and the moveable jaw define a crushing chamber having an upper opening for receiving the crushable material and a lower opening for expelling crushed material from the chamber after crushing;

a drive mechanism coupled to the moveable jaw for directing reciprocating motion of the moveable jaw; and an adjustment mechanism comprising a hydraulic ram coupled to the adjustable jaw, the hydraulic ram being configured to alter an angle of the adjustable jaw to adjust a closed side setting of the crushing chamber, which determines a size of the crushed material produced by the crusher, and to remain in a stationary position to maintain the closed side setting during operation of the crusher;

at least one sensor for measuring at least one parameter relating to operation of the crusher; and a controller configured to receive the measured parameter from the at least one sensor and, based at least in part on the measured parameter, to automatically engage the adjustment mechanism to adjust the closed side setting.

15. The system of claim 14, wherein the at least one sensor comprises a hydraulic cylinder pressure sensor associated with the hydraulic ram.

16. The system of claim 14, wherein the controller is configured to receive the measured parameter from the hydraulic cylinder pressure sensor, compare the measured parameter to a predetermined threshold value, and automatically stop the drive mechanism if the measured parameter exceeds the threshold value.

17. The system of claim 14, wherein the controller is configured to engage the hydraulic ram of the adjustment mechanism to adjust the closed side setting while the moveable jaw is being driven by the drive mechanism.

18. The system of claim 14, wherein the controller is configured to perform a pass routine, the pass routine comprising:

determining that the uncrushable material is in the crushing chamber based, at least in part, on the measured parameter from the at least one sensor;

engaging the hydraulic ram of the adjustment mechanism to increase the closed side setting to allow the uncrushable material to pass through the chamber; and after the uncrushable material passes through the chamber, engaging the hydraulic ram of the adjustment mechanism to reset the closed side setting to a predetermined width.

19. The system of claim 14, further comprising a feed system for supplying the crushable material to the crusher at a predetermined feed rate, wherein the controller is configured to perform a feed adjustment routine, the routine comprising:

measuring a motor amp level of the drive mechanism with a power sensor or a pressure of the hydraulic ram with a pressure sensor;

determining whether the motor amp level of the drive mechanism or pressure of the hydraulic ram exceeds a predetermined value; and if the predetermined value is exceeded, reducing the feed rate of the feed system or adjusting the closed side setting.

20. A system for crushing a crushable material comprising:

a crusher configured to receive the crushable material, the crusher comprising:

an adjustable jaw;

a moveable jaw;

a frame that supports the adjustable jaw and the moveable jaw such that the adjustable jaw and the moveable jaw define a crushing chamber having an upper opening for receiving the crushable material and a lower opening for expelling crushed material from the chamber after crushing;

a drive mechanism coupled to the moveable jaw for directing reciprocating motion of the moveable jaw; and an adjustment mechanism coupled to the adjustable jaw for altering an angle of the adjustable jaw and, thereby, altering a closed side setting of the crushing chamber;

at least one sensor for measuring at least one parameter relating to operation of the crusher; and a controller configured to receive the measured parameter from the at least one sensor and, based at least in part on the measured parameter, to automatically engage the adjustment mechanism to adjust the closed side setting, wherein the controller is configured to perform a calibration routine, the calibration routine comprising:

closing the adjustable jaw of the crusher with the adjustment mechanism;

measuring a pressure level of the hydraulic cylinder coupled to the adjustment mechanism with the at least one sensor;

if the pressure level is greater than a threshold value, storing the position of the adjustable jaw as a zero position closed side setting; and opening the adjustable jaw a predetermined distance from the zero position to a use position.

* * * * *